US011553271B2

(12) United States Patent
Daishoji et al.

(10) Patent No.: US 11,553,271 B2
(45) Date of Patent: Jan. 10, 2023

(54) SPEAKER APPARATUS AND ACOUSTIC SYSTEM

(71) Applicant: YAMAHA CORPORATION, Hamamatsu (JP)

(72) Inventors: Takeshi Daishoji, Hamamatsu (JP); Masao Noro, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/447,539

(22) Filed: Sep. 13, 2021

(65) Prior Publication Data

US 2022/0103932 A1 Mar. 31, 2022

(30) Foreign Application Priority Data

Sep. 28, 2020 (JP) ..... JP2020-162631

(51) Int. Cl.

| | |
|---|---|
| ***H04R 1/40*** | (2006.01) |
| ***H04R 1/28*** | (2006.01) |
| ***H04R 3/00*** | (2006.01) |
| *H04R 1/20* | (2006.01) |

(52) U.S. Cl.
CPC ..... *H04R 1/2803* (2013.01); *H04R 3/00* (2013.01); *H04R 2499/13* (2013.01)

(58) Field of Classification Search
CPC ..... H04R 1/2803; H04R 3/00; H04R 2499/13
USPC ..... 381/79, 345
See application file for complete search history.

(56) References Cited

U.S. PATENT DOCUMENTS

2005/0117767 A1* 6/2005 Ito ..... H04R 1/2849 381/301

FOREIGN PATENT DOCUMENTS

| | | |
|---|---|---|
| JP | H0974599 A | 3/1997 |
| JP | 4079827 B2 | 4/2008 |
| JP | 5988874 B2 | 9/2016 |

* cited by examiner

*Primary Examiner* — Ammar T Hamid
(74) *Attorney, Agent, or Firm* — Chip Law Group

(57) ABSTRACT

Provided is a speaker apparatus including a first speaker having a first surface communicating with an interior and a second surface not communicating with the interior; a second speaker having a first surface communicating with an exterior and a second surface not communicating with the exterior; and a cabinet having boundary surfaces that form an enclosed space. The second surface of the first speaker and the second surface of the second speaker are arranged on the boundary surfaces and are facing the enclosed space.

12 Claims, 13 Drawing Sheets

SPEAKER APPARATUS AND ACOUSTIC SYSTEM

BACKGROUND

The present disclosure relates to a speaker apparatus and an acoustic system.

There is a technology related to a speaker apparatus for forming an infinite baffle with a speaker back surface disposed so as to be directed to the outside of a vehicle (see Japanese Patent No. 5988874, for example). There is a technology related to a speaker apparatus including a main speaker and an auxiliary speaker, for installing a sound emitting surface of the auxiliary speaker so as to be directed to a back surface of the main speaker (see Japanese Patent Laid-Open No. Hei 9-74599 and Japanese Patent No. 4079827, for example).

SUMMARY

A large enclosure may be needed to reproduce bass in a speaker apparatus. However, there are cases where it is difficult to install a large enclosure, such as a case where there is a limitation of the installation space of the speaker apparatus.

In addition, in a case where it is difficult to securely attach the speaker apparatus to another object, reproduction energy is changed into vibration instead of being changed into sound. Further, the enclosure may need to be reduced in thickness in a case where the installation place of the speaker apparatus is complex or the speaker apparatus is desired to be reduced in weight. In this case, it is difficult to attach the enclosure to another object.

The present disclosure provides a speaker apparatus and an acoustic system that can reproduce bass while suppressing vibration of the speaker apparatus.

According to an embodiment of the present disclosure, there is provided a speaker apparatus including a first speaker having a first surface communicating with an interior and a second surface not communicating with the interior; a second speaker having a first surface communicating with an exterior and a second surface not communicating with the exterior; and a cabinet having boundary surfaces that form an enclosed space. The second surface of the first speaker and the second surface of the second speaker are arranged on the boundary surfaces and are facing the enclosed space.

According to an embodiment of the present disclosure, there is provided an acoustic system including the speaker apparatus and a phase control unit that generates a first sound signal and a second sound signal having different phases and supplies the first sound signal and the second sound signal to the first speaker and the second speaker, respectively.

DETAILED DESCRIPTION OF THE PREFERRED EMBODIMENTS

Figure 1:
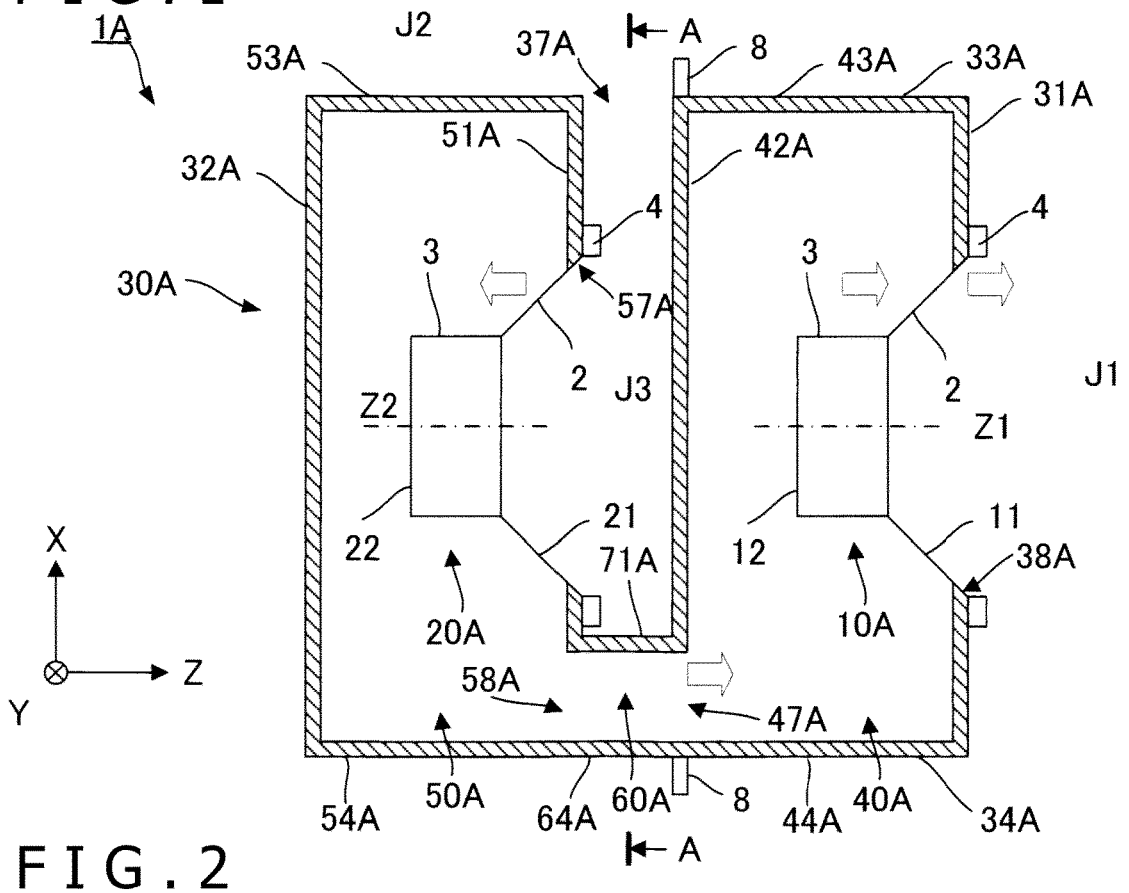
FIG. 1 is a sectional view of a speaker apparatus according to a first embodiment.

Embodiments of the present disclosure will hereinafter be described with reference to the drawings. Incidentally, in the drawing, the dimensions and scales of parts are made different from actual dimensions and actual scales as appropriate. In addition, the embodiments to be described in the following are suitable concrete examples of the present invention. Therefore, various limitations that are technically preferable are added to the present embodiments. However, the scope of the present disclosure is not limited to these examples unless there is a description that particularly limits the present disclosure in the following description.

Figure 2:
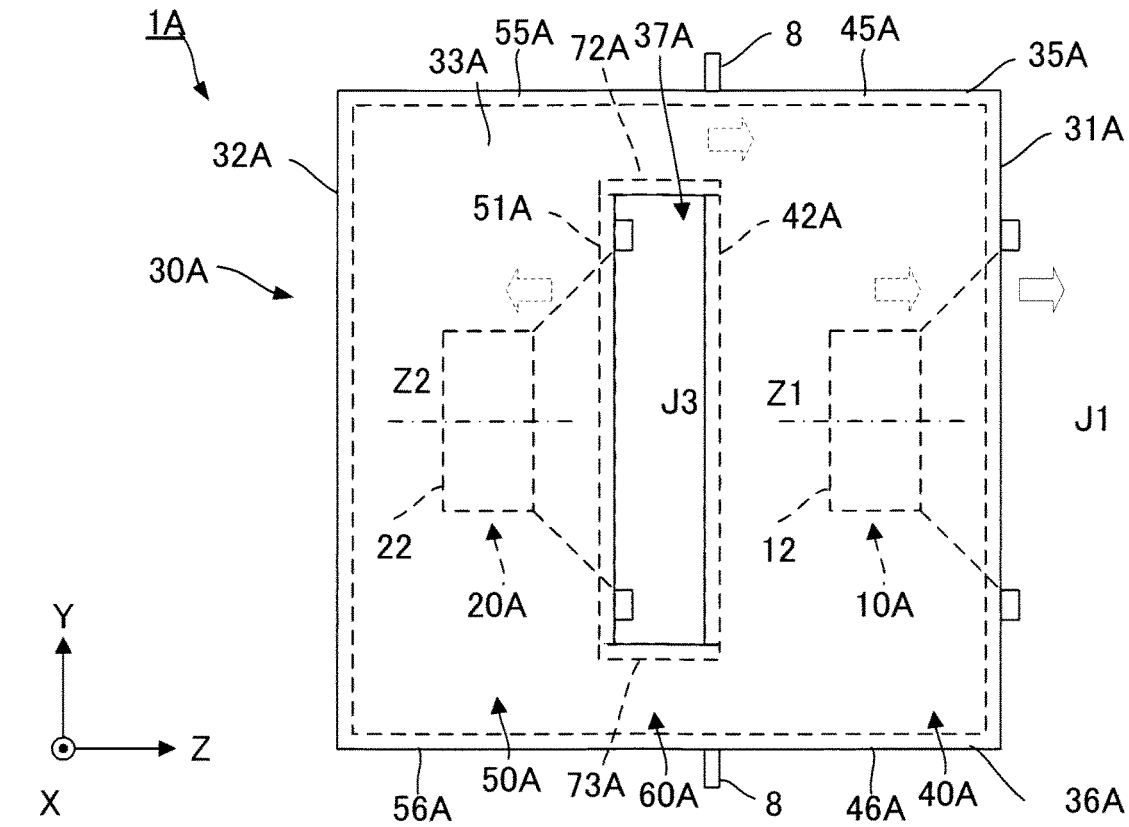
FIG. 2 is a side view of the speaker apparatus according to the first embodiment.
Figure 3:
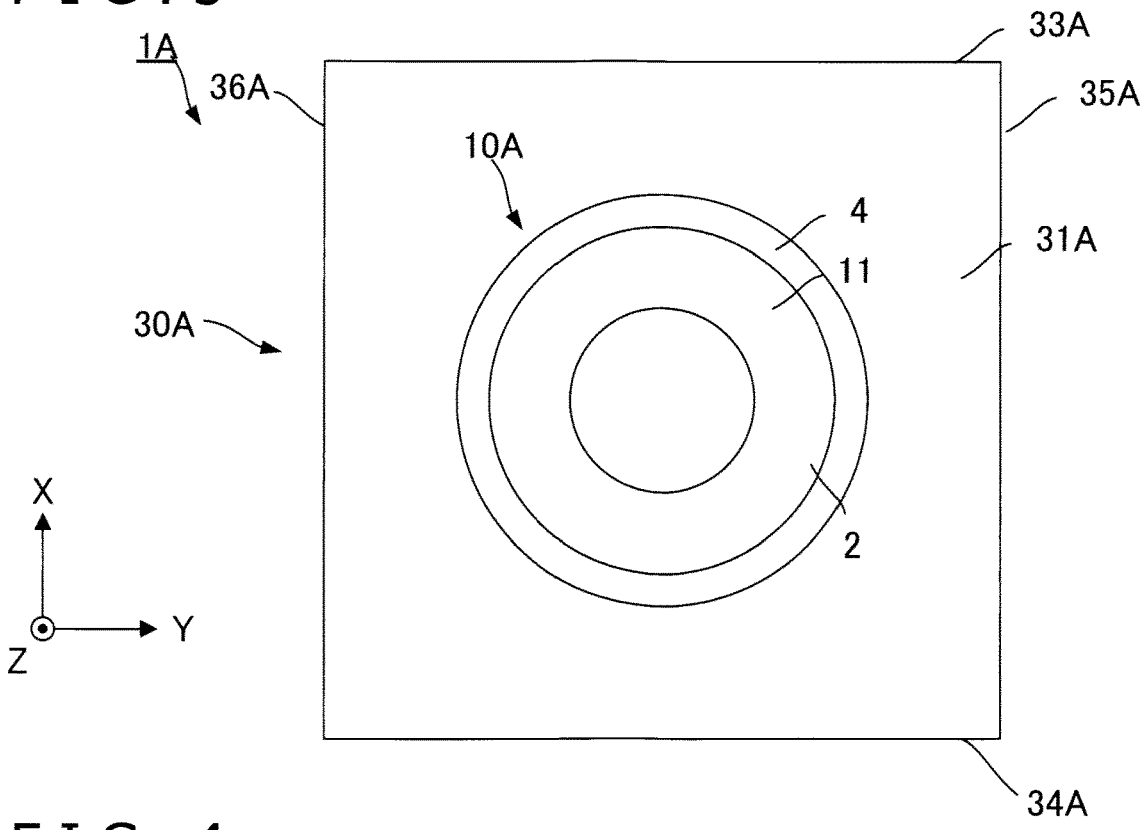
FIG. 3 is a front view of the speaker apparatus according to the first embodiment.
Figure 4:
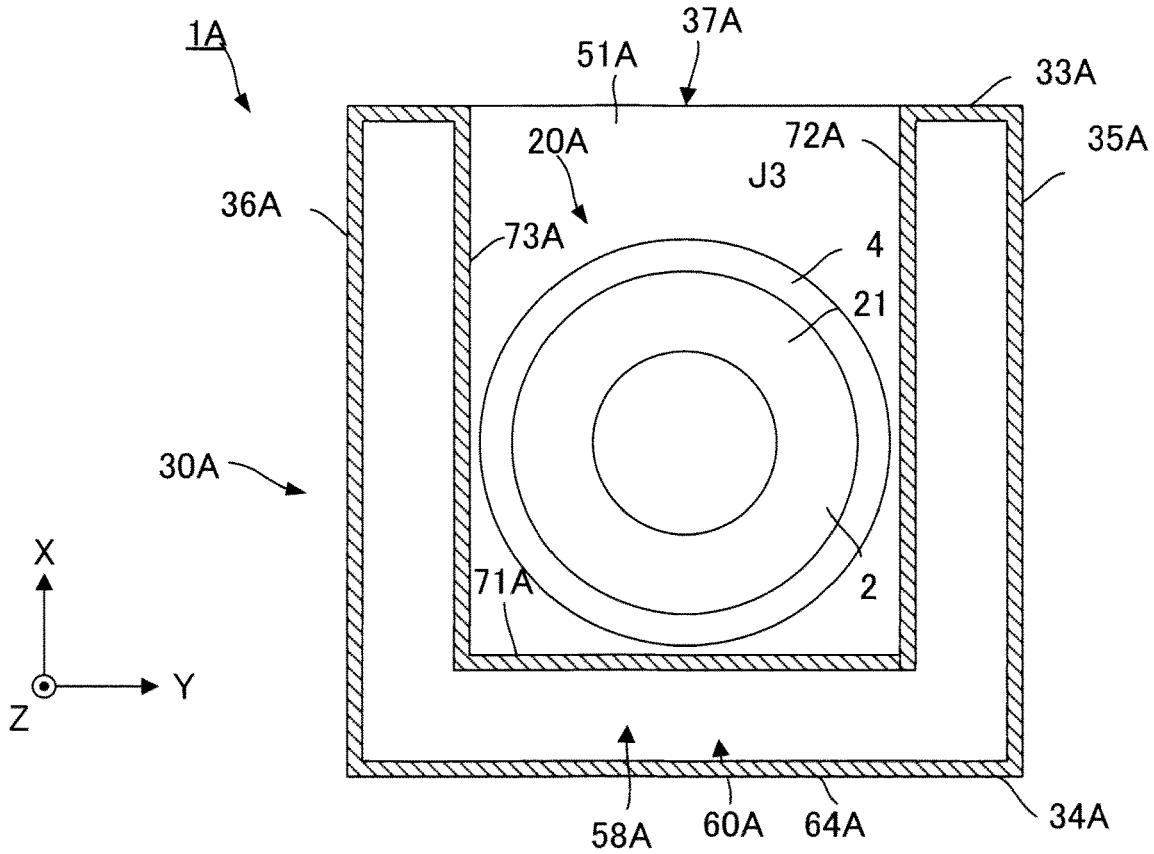
FIG. 4 is a view taken in the direction of arrows along a line A-A in FIG. 1.

FIG. 1 is a sectional view of a speaker apparatus 1A according to a first embodiment. FIG. 2 is a side view of the speaker apparatus 1A. FIG. 3 is a front view of the speaker apparatus 1A. FIG. 4 is a view taken in the direction of arrows along a line A-A in FIG. 1. The speaker apparatus 1A illustrated in FIGS. 1 to 4 can be used as, for example, a vehicle-mounted speaker apparatus mounted in a vehicle such as an automobile. The speaker apparatus 1A may be attached to a door of the vehicle via a door trim, for example. Incidentally, the applications of the speaker apparatus 1A are not limited to vehicle-mounted applications and may be other applications.

The speaker apparatus 1A includes a first speaker 10A and a second speaker 20A. FIG. 1 illustrates part of the speaker apparatus 1A in section. This section is a section obtained by sectioning the speaker apparatus 1A in a plane including an axis Z1 of the first speaker 10A and an axis Z2 of the second speaker 20A. The axis Z1 is a line segment that is parallel with the vibration direction of a diaphragm 2 to be described later and passes through the center of the diaphragm 2. An axis Z1 direction is a direction in which the axis Z1 extends.

In the description of the first speaker 10A, in the axis Z1 direction, one side on which the diaphragm 2 is disposed is a front side, and the opposite side is a back side. Of two surfaces separated from each other in the axis Z1 direction, one surface in which the diaphragm 2 is disposed is a sound emitting surface, and the other surface is a back surface. The same is true for the axis Z2. In addition, three directions orthogonal to each other is set to an X-direction, a Y-direction, and a Z-direction. The Z-direction is parallel with the axis Z1 direction.

In the description of a cabinet 30A to be described later, a right side illustrated in figures is the front side, and a left side illustrated in the figures is the back side. Incidentally, in other embodiments to be described later, the front side and the back side of a cabinet and the front side and the back side of a first speaker or the front side and the back side of a second speaker may not be the same sides in some cases.

The first speaker 10A and the second speaker 20A are of the same configuration. However, the first speaker 10A and the second speaker 20A may be of different configurations. The first speaker 10A includes a diaphragm 2, a driving unit 3, and a speaker frame 4. The second speaker 20A includes a diaphragm 2, a driving unit 3, and a speaker frame 4. The axis Z1 and the axis Z2 are coaxial.

The diaphragm 2 is a vibrating body that includes a sheet material and emits sound by vibration. The sheet material is obtained by, for example, curing or solidifying a resin material in a state in which a fiber base material is impregnated with the resin material. The resin material includes, for example, an acrylic resin, polyurethane, a melamine resin, a modified rubber resin, a phenolic resin, and other resins. The fiber base material includes, for example, a carbon fiber, an aramid fiber, a glass fiber, a ceramic fiber, a silica fiber, a metallic fiber, a potassium titanate fiber, a zirconia fiber, a polyacrylate fiber, a polyphenylene sulfide fiber, a vinylon fiber, a rayon fiber, a nylon fiber, a polyester fiber, an acrylic fiber, a polypropylene fiber, a polyethylene fiber, a cotton fiber, a hemp fiber, a cellulose fiber, and other fibers.

The diaphragm 2 vibrates in a direction along the axis Z1 or the axis Z2. The diaphragm 2 is of a conical shape. It is to be noted that the shape of the diaphragm 2 is not limited to the conical shape and may be, for example, a domical shape or other shapes.

The driving unit 3 is a mechanism that drives the diaphragm 2 on the basis of an input electric signal. The driving unit 3 includes a magnetic circuit that generates a magnetic field and a voice coil connected to the diaphragm 2. The magnetic circuit includes a magnet and a yoke. When the electric signal is input to the voice coil, the voice coil vibrates the diaphragm 2 by interaction of a magnetic force with the magnet. This vibration emits sound based on the electric signal, from the diaphragm 2. Incidentally, it suffices for the driving unit 3 to be able to drive the diaphragm 2 on the basis of the electric signal. The driving unit 3 is not limited to the configuration including the voice coil and the magnet and is configured as desired.

The first speaker 10A has a first surface 11 communicating with an interior J1 and a second surface 12 not communicating with the interior J1. The second speaker 20A has a first surface 21 communicating with an exterior J2 and a second surface 22 not communicating with the exterior J2. Communicating with the interior J1 refers to being in contact with a space of the interior J1 and not being in contact with an internal space of the cabinet 30A to be described later. Not communicating with the interior J1 refers to being in contact with the internal space of the cabinet 30A and not being in contact with the space of the interior J1. Communicating with the exterior J2 refers to being in contact with a space of the exterior J2 and not being in contact with the internal space of the cabinet 30A. Not communicating with the exterior J2 refers to being in contact with the internal space of the cabinet 30A and not being in contact with the space of the exterior J2.

In a case where the speaker apparatus 1A is mounted in an automobile, the interior J1 is the vehicle interior of the automobile, and the exterior J2 is the outside of the automobile. In a case where the speaker apparatus 1A is installed in a door of the automobile, even though the first surface 11 of the first speaker 10A is in contact with the outside of the vehicle when the door is opened, the first surface 11 is in contact with the interior J1 when the first surface 11 is in contact with the interior of the vehicle in a state in which the door is closed. In addition, the first surface 21 of the second speaker 20A communicates with the exterior J2 in a case where the first surface 21 is in contact with a space within an opening portion communicating with the outside of the vehicle. The interior of the vehicle is the interior J1 even though the interior of the vehicle communicates with the outside of the vehicle in a state in which the door or a window is opened.

The first surface 11 of the first speaker 10A is a sound emitting surface, and the second surface 12 of the first speaker 10A is a back surface. The first surface 21 of the second speaker 20A is a sound emitting surface, and the second surface 22 of the second speaker 20A is a back surface. The sound emitting surface of the first speaker 10A communicates with the interior J1. The sound emitting surface of the second speaker 20A communicates with the exterior J2.

The speaker apparatus 1A has the cabinet 30A that holds the first speaker 10A and the second speaker 20A. The cabinet 30A forms a box shape and holds the first speaker 10A and the second speaker 20A. The cabinet 30A includes a front plate 31A, a back plate 32A, a side plate 33A, a side plate 34A, a side plate 35A, and a side plate 36A. The front plate 31A and the back plate 32A are facing each other in the Z-direction. The side plate 33A and the side plate 34A are facing each other in the X-direction. The side plate 35A and the side plate 36A are facing each other in the Y-direction. An opening portion 37A is formed in the side plate 33A. The opening portion 37A is formed in a central portion of the side plate 33A in the Z-direction.

The cabinet 30A has boundary surfaces that form an enclosed space. The boundary surfaces include the front plate 31A, the back plate 32A, the side plate 33A, the side plate 34A, the side plate 35A, and the side plate 36A. The boundary surfaces include a back plate 42A of a first cabinet 40A and a front plate 51A of a second cabinet 50A to be described later. The boundary surfaces include an inner wall plate 71A, an inner wall plate 72A, and an inner wall plate 73A of a coupling portion 60A to be described later. The cabinet 30A forms the enclosed space as an enclosed internal space in a state of holding the first speaker 10A and the second speaker 20A. Forming the enclosed space using the boundary surfaces includes forming the enclosed internal space in the state of holding the first speaker 10A and the second speaker 20A.

The second surface 12 of the first speaker 10A and the second surface 22 of the second speaker 20A are arranged on the boundary surfaces of the cabinet 30A and are facing the enclosed space. Arranging the second surface 12 and the second surface 22 on the boundary surfaces of the cabinet 30A so as to face the enclosed space includes arranging the second surface 12 and the second surface 22 so as to be in contact with the internal space of the cabinet 30A.

An attachment piece 8 is disposed on the cabinet 30A. The attachment piece 8 protrudes from the side plates 33A to 36A of the cabinet 30A to the outside. The speaker apparatus 1A is attached to another member via the attachment piece 8. On the outside of the speaker apparatus 1A, a space on a front side of the attachment piece 8 is the interior J1, and a space on a back side of the attachment piece 8 is the exterior J2. The attachment piece 8 may be a flange, a channel, or other forms.

The cabinet 30A includes the first cabinet 40A, the second cabinet 50A, and the coupling portion 60A. The coupling portion 60A is disposed between the first cabinet 40A and the second cabinet 50A in the Z-direction. The coupling portion 60A allows the first cabinet 40A and the second cabinet 50A to communicate with each other.

The first cabinet 40A holds the first speaker 10A. The first cabinet 40A includes the front plate 31A and the back plate 42A facing each other in the Z-direction. The first cabinet 40A includes a first part 43A of the side plate 33A, a first part 44A of the side plate 34A, a first part 45A of the side plate 35A, and a first part 46A of the side plate 36A.

An opening portion 38A holding the first speaker 10A is formed in the front plate 31A. The speaker frame 4 of the first speaker 10A is fixed to a peripheral portion of the opening portion 38A. The diaphragm 2 and the driving unit 3 of the first speaker 10A are housed within the first cabinet 40A.

The first part 43A of the side plate 33A and the first part 44A of the side plate 34A are facing each other in the X-direction. The first part 45A of the side plate 35A and the first part 46A of the side plate 36A are facing each other in the Y-direction. An opening portion 47A is formed between the back plate 42A and the side plate 34A in the X-direction.

The second cabinet 50A holds the second speaker 20A. The second cabinet 50A includes the front plate 51A and the back plate 32A facing each other in the Z-direction. The second cabinet 50A includes a second part 53A of the side plate 33A, a second part 54A of the side plate 34A, a second part 55A of the side plate 35A, and a second part 56A of the side plate 36A.

An opening portion 57A holding the second speaker 20A is formed in the front plate 51A. The speaker frame 4 of the second speaker 20A is fixed to a peripheral portion of the opening portion 57A. The diaphragm 2 and the driving unit 3 of the second speaker 20A are housed within the second cabinet 50A.

The second part 53A of the side plate 33A and the second part 54A of the side plate 34A are facing each other in the X-direction. The second part 55A of the side plate 35A and the second part 56A of the side plate 36A are facing each other in the Y-direction. An opening portion 58A is formed between the front plate 51A and the side plate 34A in the X-direction.

The coupling portion 60A includes the inner wall plate 71A and a third part 64A of the side plate 34A, the inner wall plate 71A and the third part 64A being facing each other in the X-direction. An internal space of the coupling portion 60A communicates with an internal space of the first cabinet 40A and an internal space of the second cabinet 50A through the opening portion 47A and the opening portion 58A.

The internal space of the cabinet 30A includes the internal space of the first cabinet 40A, the internal space of the second cabinet 50A, and the internal space of the coupling portion 60A. The internal space of the cabinet 30A is an enclosed space and is not made to communicate with the interior J1 nor the exterior J2. The second surface 12 as the back surface of the first speaker 10A and the second surface 22 as the back surface of the second speaker 20A are in contact with the internal space of the cabinet 30A.

An open space J3 communicating with the exterior J2 is formed on the front side of the second speaker 20A. The open space J3 communicates with the exterior J2 through the opening portion 37A. The open space J3 includes a space formed between the back plate 42A of the first cabinet 40A and the front plate 51A of the second cabinet 50A in the Z-direction.

As illustrated in FIG. 4, the open space J3 is divided from the internal space of the cabinet 30A by the inner wall plate 71A, the inner wall plate 72A, and the inner wall plate 73A. The inner wall plate 72A and the inner wall plate 73A are arranged on the outside of the second speaker 20A in the Y-direction. The inner wall plate 72A is facing the side plate 35A in the Y-direction. The inner wall plate 73A is facing the side plate 36A in the Y-direction.

Figure 5:
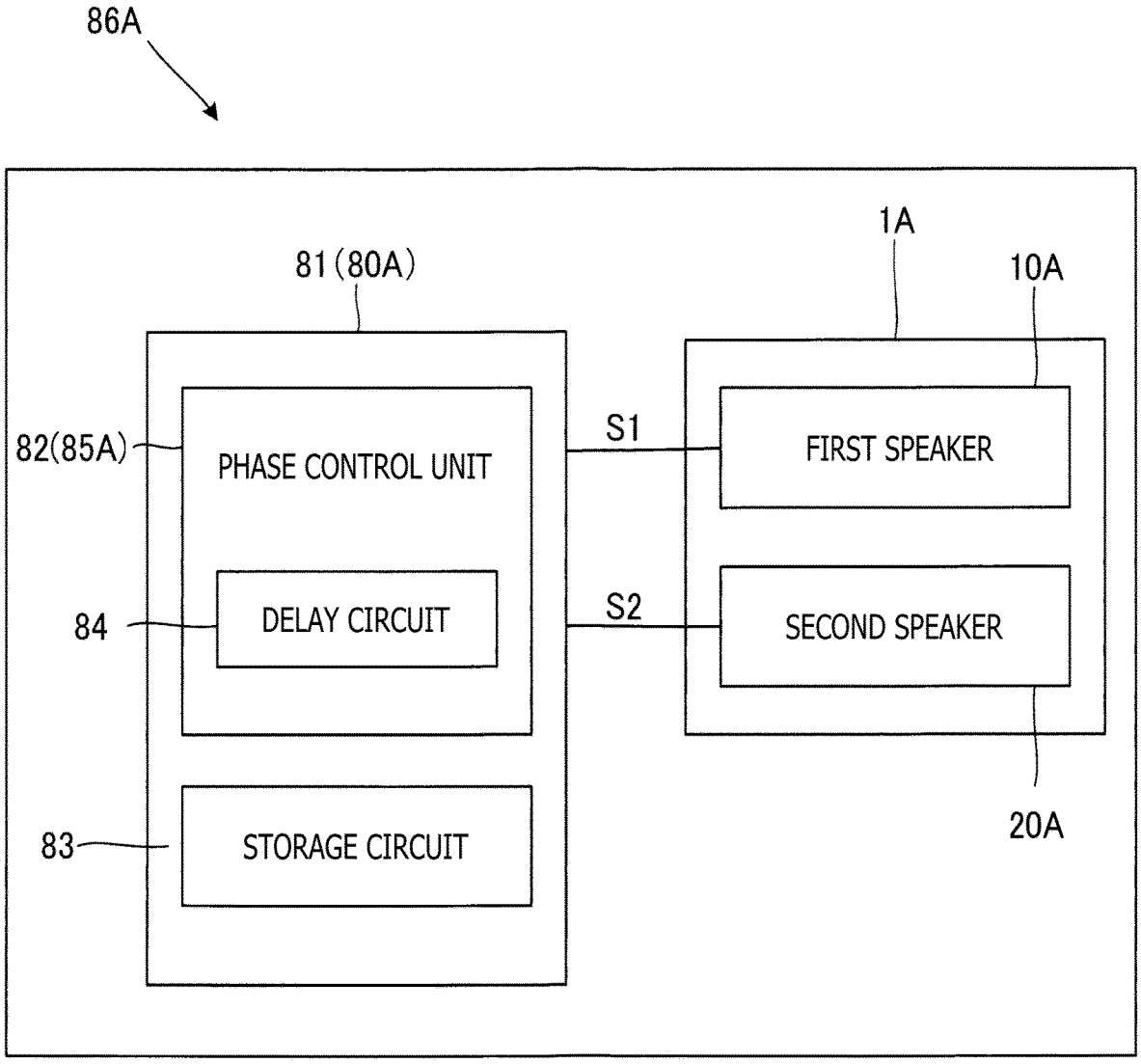
FIG. 5 is a block diagram of an acoustic system according to the first embodiment.

An acoustic system 86A according to the first embodiment will next be described with reference to FIG. 5. FIG. 5 is a block diagram of the acoustic system 86A. The acoustic system 86A includes the speaker apparatus 1A and a phase control device 80A. The phase control device 80A includes a control unit 81. The control unit 81 controls an electric signal S1 and an electric signal S2 to be output to the first speaker 10A and the second speaker 20A. The control unit 81 includes, for example, a processing circuit 82 such as a central processing unit (CPU) or a field programmable gate array (FPGA) and a storage circuit 83 such as a semiconductor memory.

The storage circuit 83 stores a control program and various kinds of parameters used to perform phase control of the electric signals. In addition, the storage circuit 83 functions as a work area of the processing circuit 82. The processing circuit 82 reads the control program from the storage circuit 83. The processing circuit 82 functions as a control center of the speaker apparatus 1A by executing the read control program. The control unit 81 outputs the electric signal S1 to the first speaker 10A and outputs the electric signal S2 to the second speaker 20A.

The processing circuit 82 functions as a phase control unit 85A that controls the phases of the electric signal S1 to be output to the first speaker 10A and the electric signal S2 to be output to the second speaker 20A. The processing circuit 82 includes a delay circuit 84. The phase control unit 85A generates a first sound signal and a second sound signal having different phases. The first sound signal is the electric signal S1. The second sound signal is the electric signal S2.

The processing circuit 82 generates the electric signal S1 and the electric signal S2 having phases opposite to each other. Thus, the diaphragm 2 of the first speaker 10A and the diaphragm 2 of the second speaker 20A vibrate in directions opposite to each other. Here, "vibrating in opposite directions" means that the diaphragm 2 of the first speaker 10A moves to the back side when the diaphragm 2 of the second speaker 20A moves to the front side, and that the diaphragm 2 of the first speaker 10A moves to the front side when the diaphragm 2 of the second speaker 20A moves to the back side.

For example, when the diaphragm 2 of the second speaker 20A moves to the back side, the diaphragm 2 of the first speaker 10A moves to the front side. When the diaphragm 2 of the second speaker 20A moves to the back side, vibration is transmitted within the cabinet 30A. In the cabinet 30A, the vibration is transmitted in order of the internal space of the second cabinet 50A, the internal space of the coupling portion 60A, and the internal space of the first cabinet 40A. Thus, when the vibration of the diaphragm 2 of the second speaker 20A moves to the back side, the vibration is transmitted to the diaphragm 2 of the first speaker 10A so as to push out the diaphragm 2 from the back side to the front side in the internal space of the first cabinet 40A. The phase control unit 85A performs phase control of the electric signal S1 such that the diaphragm 2 of the first speaker 10A moves from the back side to the front side. The condensation and rarefaction of air are consequently suppressed in the internal space of the cabinet 30A. Suppressing the condensation and rarefaction of air refers to suppressing a change in pressure within the cabinet 30A.

Similarly, when the diaphragm 2 of the second speaker 20A moves to the front side, for example, the diaphragm 2 of the first speaker 10A moves to the back side. When the diaphragm 2 of the second speaker 20A moves to the front side, vibration is transmitted within the cabinet 30A. In the cabinet 30A, the vibration is transmitted in order of the internal space of the second cabinet 50A, the internal space of the coupling portion 60A, and the internal space of the first cabinet 40A. Thus, when the vibration of the diaphragm 2 of the second speaker 20A moves to the front side, the vibration is transmitted to the diaphragm 2 of the first speaker 10A so as to pull the diaphragm 2 from the back side in the internal space of the first cabinet 40A. The phase control unit 85A performs phase control of the electric signal S1 such that the diaphragm 2 of the first speaker 10A moves from the front side to the back side. The condensation and rarefaction of air are consequently suppressed in the internal space of the cabinet 30A.

As described above, the direction in which the diaphragm 2 of the first speaker 10A is displaced and the direction in which the diaphragm 2 of the second speaker 20A is displaced are opposite to each other. The phase of the electric signal S1 and the phase of the electric signal S2 are therefore in the opposite phase relation. However, in the cabinet 30A, the vibration of the second speaker 20A is transmitted to the first speaker 10A via air in the internal space. Hence, it takes time to transmit the vibration of the second speaker 20A to the first speaker 10A.

The delay circuit 84 can delay the electric signal S1 with respect to the electric signal S2. The delay circuit 84 delays the electric signal S1 with respect to the electric signal S2 according to a transmission path of the vibration from the second speaker 20A to the first speaker 10A. Here, the transmission path of the vibration refers to the transmission path of the vibration via air within the cabinet 30A. The delay circuit 84 delays the electric signal S1 such that, in a timing in which the vibration of the second speaker 20A is transmitted to the first speaker 10A via air within the cabinet 30A, the first speaker 10A vibrates in the same manner. The phase control unit 85A performs phase control of the electric signal S1 and the electric signal S2 such that the phase of the vibration transmitted from the second speaker 20A to the first speaker 10A and the phase of displacement of the diaphragm 2 by the electric signal S1 input to the first speaker 10A are the same phase. Incidentally, the delay circuit 84 may be omitted when the vibration transmitted via the transmission path is small. In addition, also when the cabinet 30A has a small volume and the transmission path is short, a phase difference does not occur easily, and therefore, the delay circuit 84 may be omitted. The delay circuit 84 can be omitted particularly when the resonance frequency of the cabinet 30A is low (a few ten to a few hundred Hz).

In the speaker apparatus 1A, the back surface of the first speaker 10A and the back surface of the second speaker 20A are in contact with the internal space of the cabinet 30A. The vibration of the diaphragm 2 of the second speaker 20A is transmitted through the internal space of the cabinet 30A and is then transmitted to the diaphragm 2 of the first speaker 10A. The speaker apparatus 1A controls the condensation and rarefaction of the internal space of the cabinet 30A.

In the speaker apparatus 1A described above, the condensation and rarefaction of air in the internal space of the cabinet 30A can be suppressed, and the vibration direction of air within the cabinet 30A and the vibration direction of the diaphragm 2 of the first speaker 10A can be made to coincide with each other. The first speaker 10A and the second speaker 20A are arranged coaxially and are arranged in the same orientation. Consequently, the condensation and rarefaction of air in the internal space of the cabinet 30A are suppressed because the diaphragm 2 of the second speaker 20A moves to expand (or compress) the internal space of the cabinet 30A when the diaphragm 2 of the first speaker 10A moves to compress (or expand) the internal space of the cabinet 30A. In addition, because the diaphragm 2 of the second speaker 20A moves to the back side of the cabinet 30A when the diaphragm 2 of the first speaker 10A moves to the front side of the cabinet 30A, a shift in the center of gravity of the cabinet 30A is suppressed, and the vibration of the cabinet 30A is suppressed.

In the speaker apparatus 1A, the sound emitting surface of the second speaker 20A communicates with the exterior J2. According to the speaker apparatus 1A described above, it is possible to reproduce bass without a need for a large enclosure, by making the second speaker 20A function as an infinite baffle. Therefore, an increase in size of the speaker apparatus 1A is avoided, and bass reproduction is realized.

In the speaker apparatus 1A, the internal space of the cabinet 30A can be made to be a sealed space, so that a foreign matter can be prevented from being mixed into the internal space of the cabinet 30A from the exterior J2. In a case where the speaker apparatus 1A is applied as a vehicle-mounted speaker, a foreign matter such as water or dust is prevented from being mixed into the internal space of the cabinet 30A from the exterior J2 as a space outside the vehicle. Because the foreign matter is prevented from being mixed into the cabinet 30A, the foreign matter is prevented from being mixed into the interior J1 via the cabinet 30A.

Figure 6:
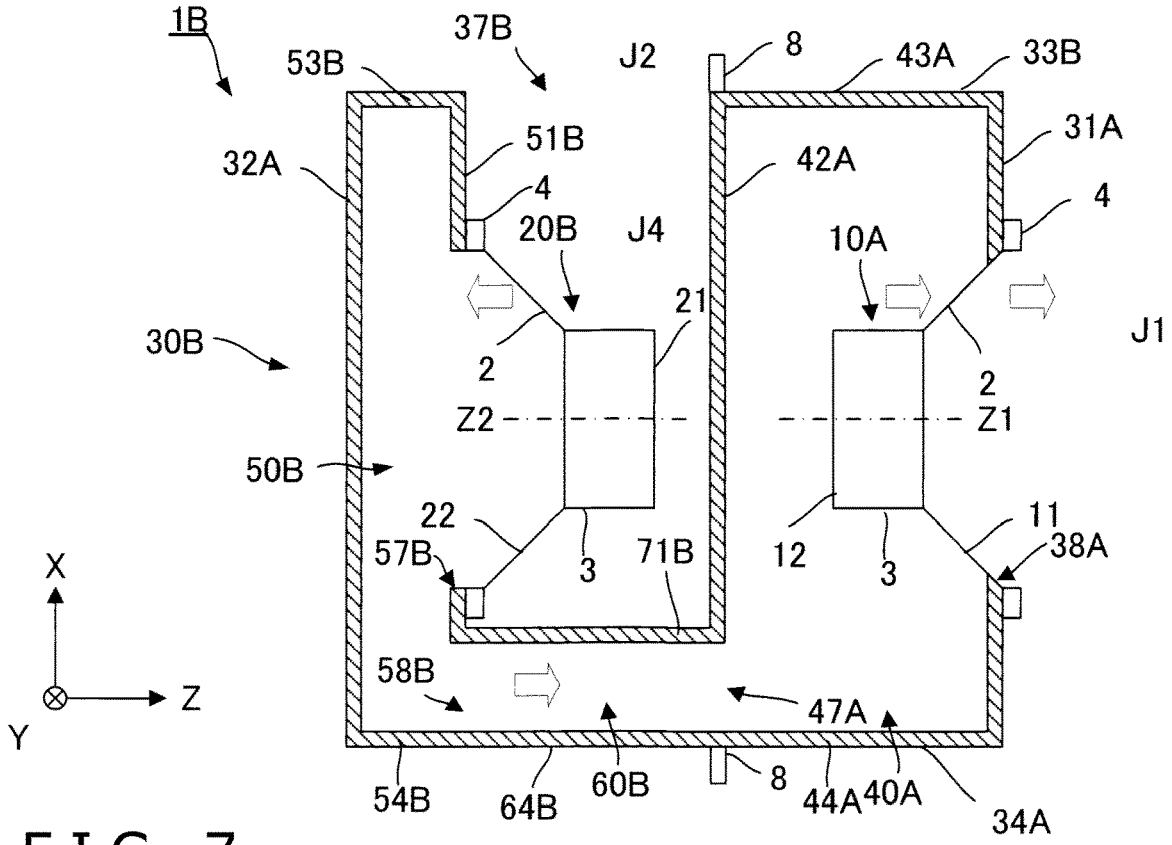
FIG. 6 is a sectional view of a speaker apparatus according to a second embodiment.
Figure 7:
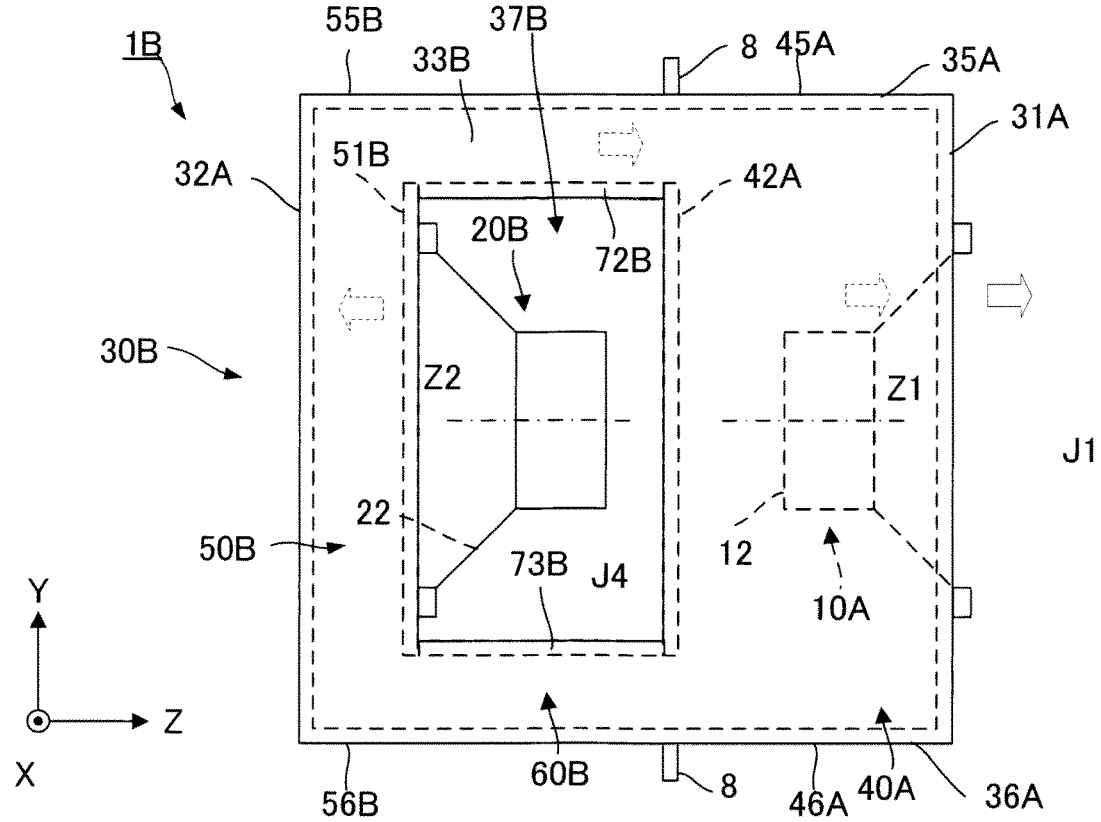
FIG. 7 is a side view of the speaker apparatus according to the second embodiment.

A speaker apparatus 1B according to a second embodiment will next be described. FIG. 6 is a sectional view of the speaker apparatus 1B. FIG. 7 is a side view of the speaker apparatus 1B. The speaker apparatus 1B according to the second embodiment is different from the speaker apparatus 1A according to the first embodiment in terms of a different disposition of a second speaker 20B, a different configuration of a cabinet 30B, and different phase control by a phase control unit 85B illustrated in FIG. 8. The points different from the first embodiment will mainly be described in the description of the second embodiment. The speaker apparatus 1B includes a first speaker 10A and the second speaker 20B. The second speaker 20B is disposed in an orientation opposite to that of the second speaker 20A in the first embodiment.

The second speaker 20B has a first surface 21 communicating with an exterior J2 and a second surface 22 not communicating with the exterior J2. The first surface 21 of the second speaker 20B is a back surface, and the second surface 22 of the second speaker 20B is a sound emitting surface. The back surface of the second speaker 20B communicates with the exterior J2. The back surface of the first speaker 10A and the back surface of the second speaker 20B are facing each other in the Z-direction.

The speaker apparatus 1B has the cabinet 30B that holds the first speaker 10A and the second speaker 20B. The cabinet 30B forms a box shape and holds the first speaker 10A and the second speaker 20B. The cabinet 30B includes a front plate 31A, a back plate 32A, a side plate 33B, a side plate 34A, a side plate 35A, and a side plate 36A. The front plate 31A and the back plate 32A are facing each other in the Z-direction. The side plate 33B and the side plate 34A are facing each other in the X-direction. An opening portion 37B is formed in the side plate 33B. The opening portion 37B is formed in a position corresponding to the second speaker 20B in the Z-direction. As viewed from the X-direction, a diaphragm 2 and a driving unit 3 of the second speaker 20B are arranged within the opening portion 37B.

The cabinet 30B includes a first cabinet 40A, a second cabinet 50B, and a coupling portion 60B. The coupling portion 60B is disposed between the first cabinet 40A and the second cabinet 50B in the Z-direction. The coupling portion 60B allows the first cabinet 40A and the second cabinet 50B to communicate with each other.

The first cabinet 40A includes a first part 43A of the side plate 33B, a first part 44A of the side plate 34A, a first part 45A of the side plate 35A, and a first part 46A of the side plate 36A.

The first part 43A of the side plate 33B and the first part 44A of the side plate 34A are facing each other in the X-direction.

The second cabinet 50B holds the second speaker 20B. The second cabinet 50B includes an inner wall plate 51B and the back plate 32A facing each other in the Z-direction. The second cabinet 50B includes a second part 53B of the side plate 33B, a second part 54B of the side plate 34A, a second part 55B of the side plate 35A, and a second part 56B of the side plate 36A.

An opening portion 57B holding the second speaker 20B is formed in the inner wall plate 51B. A speaker frame 4 of the second speaker 20B is fixed to a peripheral portion surrounding the opening portion 57B. The diaphragm 2 and the driving unit 3 of the second speaker 20B are arranged on the outside of the second cabinet 50B. The second speaker 20B is disposed between a back plate 42A of the first cabinet 40A and the inner wall plate 51B of the second cabinet 50B in the Z-direction.

The second part 53B of the side plate 33B and the second part 54B of the side plate 34A are facing each other in the X-direction. The second part 55B of the side plate 35A and the second part 56B of the side plate 36A are facing each other in the Y-direction. An opening portion 58B is formed between the inner wall plate 51B and the side plate 34A in the X-direction.

The coupling portion 60B includes an inner wall plate 71B and a third part 64B of the side plate 34A, the inner wall plate 71B and the third part 64B being facing each other in the X-direction. An internal space of the coupling portion 60B communicates with an internal space of the first cabinet 40A and an internal space of the second cabinet 50B. The second cabinet 50B and the coupling portion 60B are made to communicate with each other through the opening portion 58B. The coupling portion 60B and the first cabinet 40A are made to communicate with each other through an opening portion 47A.

An internal space of the cabinet 30B includes the internal space of the first cabinet 40A, the internal space of the second cabinet 50B, and the internal space of the coupling portion 60B. The internal space of the cabinet 30B is an enclosed space and is not made to communicate with the interior J1 nor the exterior J2. A second surface 12 as the back surface of the first speaker 10A and the second surface 22 as the sound emitting surface of the second speaker 20B are in contact with the internal space of the cabinet 30B.

An open space J4 communicating with the exterior J2 is formed on the back side of the second speaker 20B. The open space J4 communicates with the exterior J2 through the opening portion 37B. The open space J4 is formed between the back plate 42A of the first cabinet 40A and the inner wall plate 51B of the second cabinet 50B in the Z-direction.

The open space J4 is divided from the internal space of the cabinet 30B by the inner wall plate 71B, an inner wall plate 72B, and an inner wall plate 73B. The inner wall plate 72B and the inner wall plate 73B are arranged on the outside of the second speaker 20B in the Y-direction. The inner wall plate 72B is facing the side plate 35A in the Y-direction. The inner wall plate 73B is facing the side plate 36A in the Y-direction.

Figure 8:
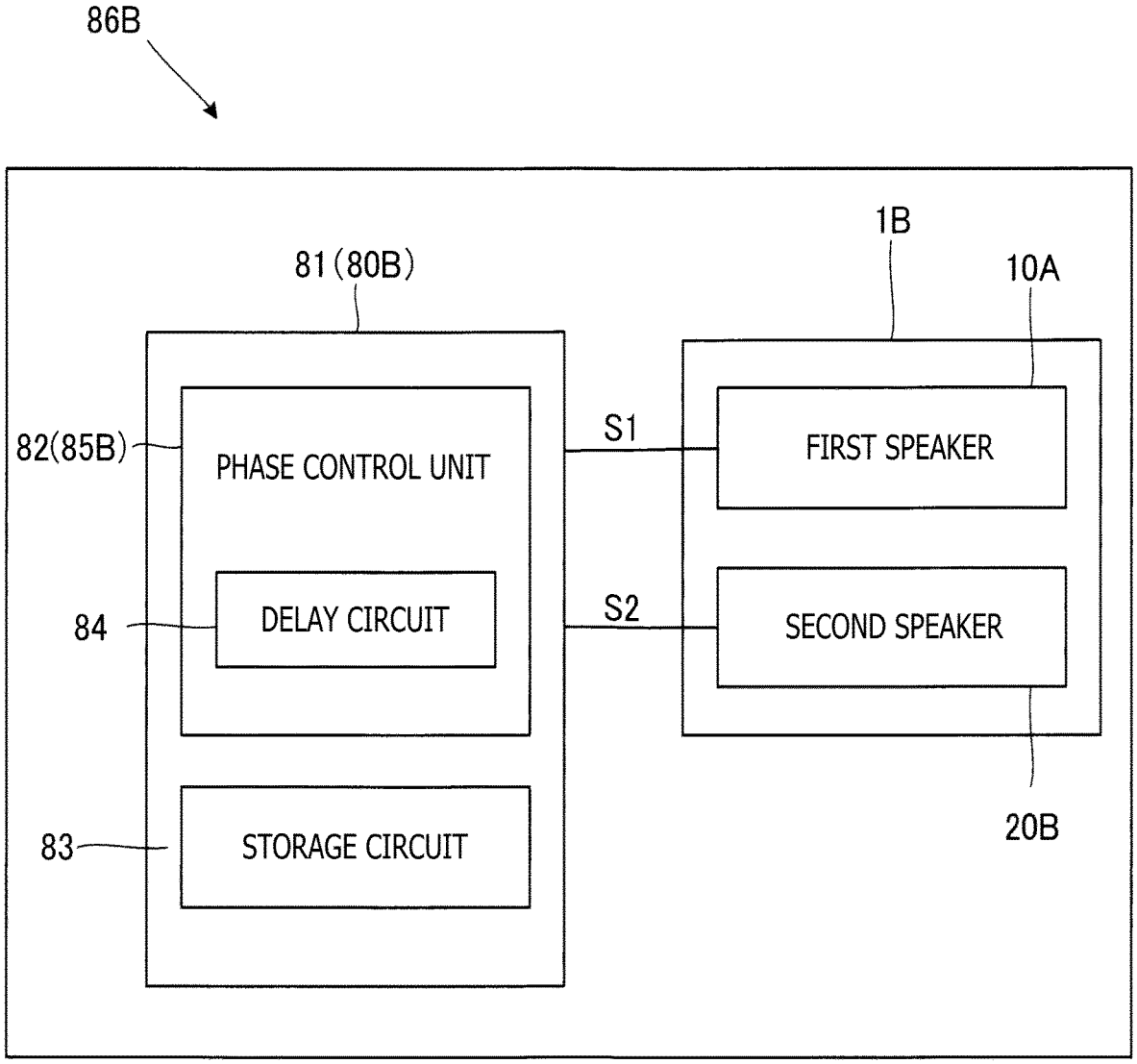
FIG. 8 is a block diagram of an acoustic system according to the second embodiment.

An acoustic system 86B according to the second embodiment will next be described with reference to FIG. 8. FIG. 8 is a block diagram of the acoustic system 86B. The acoustic system 86B includes the speaker apparatus 1B and a phase control device 80B. The phase control device 80B includes a control unit 81.

The device configuration of the phase control device 80B applied to the speaker apparatus 1B is similar to the device configuration of the phase control device 80A in the first embodiment. The control unit 81 outputs an electric signal S1 to the first speaker 10A and outputs an electric signal S2 to the second speaker 20B.

The processing circuit 82 generates the electric signal S1 and the electric signal S2 in phase with each other. Thus, the diaphragm 2 of the first speaker 10A and the diaphragm 2 of the second speaker 20B vibrate in the same direction. Here, "vibrating in the same direction" means that the diaphragm 2 of the first speaker 10A moves to the front side when the diaphragm 2 of the second speaker 20B moves to the front side, and that the diaphragm 2 of the first speaker 10A moves to the back side when the diaphragm 2 of the second speaker 20B moves to the back side.

For example, when the diaphragm 2 of the second speaker 20B moves to the front side, the diaphragm 2 of the first speaker 10A moves to the front side. When the diaphragm 2 of the second speaker 20B moves to the front side, vibration is transmitted within the cabinet 30B. In the cabinet 30B, the vibration is transmitted in order of the internal space of the second cabinet 50B, the internal space of the coupling portion 60B, and the internal space of the first cabinet 40A. Thus, when the vibration of the diaphragm 2 of the second speaker 20B moves to the front side, the vibration is transmitted to the diaphragm 2 of the first speaker 10A so as to push out the diaphragm 2 from the back side to the front side in the internal space of the first cabinet 40A. The phase control unit 85B performs phase control of the electric signal S1 such that the diaphragm 2 of the first speaker 10A moves from the back side to the front side. The condensation and rarefaction of air are consequently suppressed in the internal space of the cabinet 30B.

Similarly, when the diaphragm 2 of the second speaker 20B moves to the back side, for example, the diaphragm 2 of the first speaker 10A moves to the back side. When the diaphragm 2 of the second speaker 20B moves to the back side, vibration is transmitted within the cabinet 30B. In the cabinet 30B, the vibration is transmitted in order of the internal space of the second cabinet 50B, the internal space of the coupling portion 60B, and the internal space of the first cabinet 40A. Thus, when the vibration of the diaphragm 2 of the second speaker 20B moves to the back side, the vibration is transmitted to the diaphragm 2 of the first speaker 10A so as to pull the diaphragm 2 to the back side in the internal space of the first cabinet 40A. The phase control unit 85B performs phase control of the electric signal S1 such that the diaphragm 2 of the first speaker 10A moves from the front side to the back side. The condensation and rarefaction of air are consequently suppressed in the internal space of the cabinet 30B.

The delay circuit 84 can delay the electric signal S1 with respect to the electric signal S2. The delay circuit 84 delays the electric signal S1 with respect to the electric signal S2 according to a transmission path of the vibration from the second speaker 20B to the first speaker 10A. Here, the transmission path of the vibration refers to the transmission path of the vibration via air within the cabinet 30B. The delay circuit 84 delays the electric signal S1 such that, in a timing in which the vibration of the second speaker 20B is transmitted to the first speaker 10A via air within the cabinet 30B, the first speaker 10A vibrates in the same manner. The phase control unit 85B performs phase control of the electric signal S1 and the electric signal S2 such that the phase of the vibration transmitted from the second speaker 20B to the first speaker 10A and the phase of displacement of the diaphragm 2 by the electric signal S1 input to the first speaker 10A are the same phase. Incidentally, the delay circuit 84 may be omitted when the vibration transmitted via the transmission path is small. In addition, also when the cabinet 30B has a small volume and the transmission path is short, a phase difference does not occur easily, and therefore, the delay circuit 84 may be omitted. The delay circuit 84 can be omitted particularly when the resonance frequency of the cabinet 30B is low (a few ten to a few hundred Hz).

Similarly to the case in the speaker apparatus 1A according to the first embodiment, also in the speaker apparatus 1B according to the second embodiment, the condensation and rarefaction of air in the internal space of the cabinet 30B can be suppressed, and a shift in the center of gravity of the cabinet 30B can be suppressed.

Figure 9:
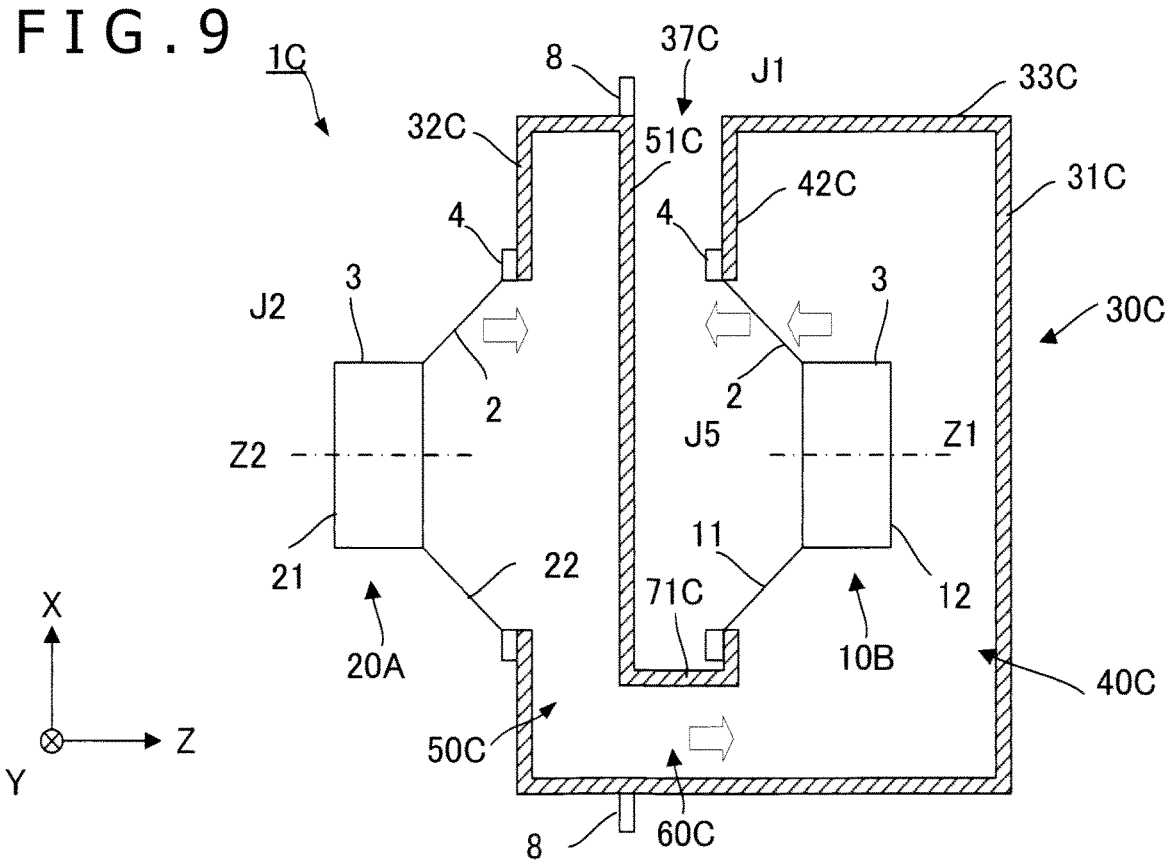
FIG. 9 is a sectional view of a speaker apparatus according to a third embodiment.
Figure 10:
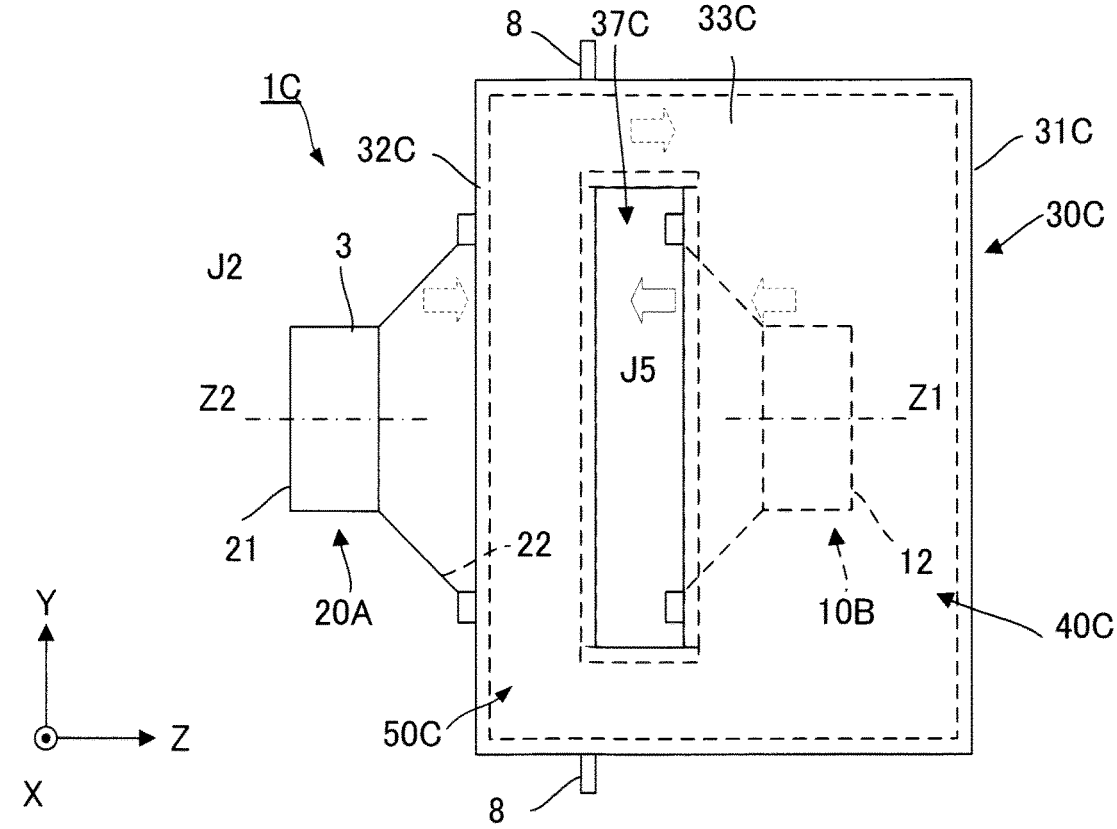
FIG. 10 is a side view of the speaker apparatus according to the third embodiment.

A speaker apparatus 1C according to a third embodiment will next be described. FIG. 9 is a sectional view of the speaker apparatus 1C. FIG. 10 is a side view of the speaker apparatus 1C. A cabinet 30C of the speaker apparatus 1C includes a first cabinet 40C holding a first speaker 10B, a second cabinet 50C holding a second speaker 20A, and a coupling portion 60C coupling the first cabinet 40C and the second cabinet 50C to each other. The first speaker 10B is disposed in an orientation opposite to that of the first speaker 10A in the first embodiment.

A first surface 11 of the first speaker 10B is a sound emitting surface, and a second surface 12 of the first speaker 10B is a back surface. A first surface 21 of the second speaker 20A is a back surface, and a second surface 22 of the second speaker 20A is a sound emitting surface. The sound emitting surface of the first speaker 10B communicates with an interior J1. The back surface of the second speaker 20B communicates with an exterior J2. The sound emitting surface of the first speaker 10B and the sound emitting surface of the second speaker 20A are facing each other in the Z-direction. In the speaker apparatus 1C, the back surface of the first speaker 10B and the sound emitting surface of the second speaker 20A are in contact with an internal space of the cabinet 30C.

The first cabinet 40C includes a front plate 31C and an inner wall plate 42C facing each other in the Z-direction. The first speaker 10B is attached to an opening portion of the inner wall plate 42C. The back surface of the first speaker 10B is facing the front plate 31C in the Z-direction. The second cabinet 50C includes a back plate 32C and an inner wall plate 51C facing each other in the Z-direction. The second speaker 20A is attached to an opening portion of the back plate 32C. A driving unit 3 of the second speaker 20A projects outward from the back plate 32C in the Z-direction.

A communicating space J5 communicating with the interior J1 is formed between the first cabinet 40C and the second cabinet 50C. The communicating space J5 is formed between the inner wall plate 42C and the inner wall plate 51C. The communicating space J5 communicates with the interior J1 through an opening portion 37C formed in a side plate 33C of the cabinet 30C.

The processing circuit 82 of the phase control device 80B applied to the speaker apparatus 10 can generate an electric signal S1 and an electric signal S2 in phase with each other. The delay circuit 84 can delay the electric signal S1 with respect to the electric signal S2. Similarly to the case in the speaker apparatus 1B according to the second embodiment, also in the speaker apparatus 10 according to the third embodiment, the condensation and rarefaction of air in the internal space of the cabinet 30C can be suppressed, and a shift in the center of gravity of the cabinet 30C can be suppressed.

Figure 11:
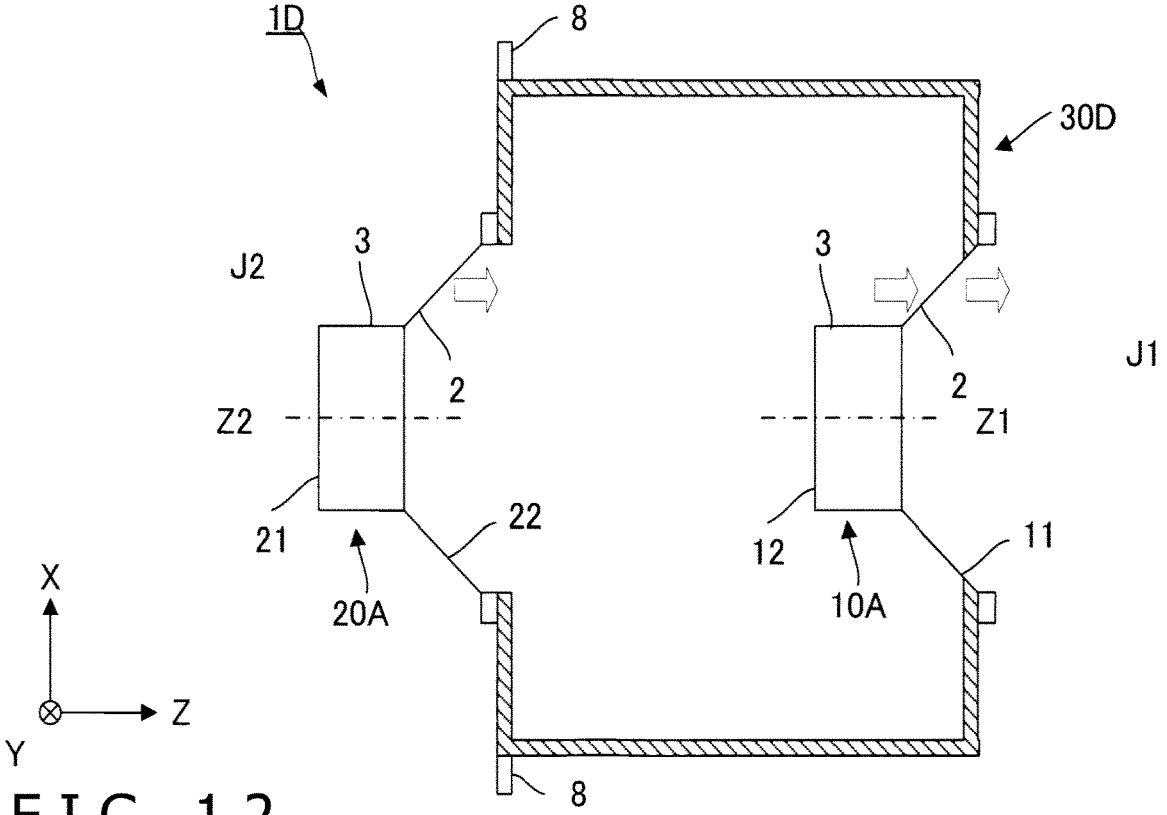
FIG. 11 is a sectional view of a speaker apparatus according to a fourth embodiment.

FIG. 11 is a sectional view of a speaker apparatus 1D according to a fourth embodiment. A cabinet 30D of the speaker apparatus 1D holds a first speaker 10A and a second speaker 20A.

A first surface 11 of the first speaker 10A is a sound emitting surface, and a second surface 12 of the first speaker 10A is a back surface. A first surface 21 of the second speaker 20A is a back surface, and a second surface 22 of the second speaker 20A is a sound emitting surface. The sound emitting surface of the first speaker 10A communicates with an interior J1. The back surface of the second speaker 20A communicates with an exterior J2. The back surface of the first speaker 10A and the sound emitting surface of the second speaker 20A are facing each other in the Z-direction. In the speaker apparatus 1D, the back surface of the first speaker 10A and the sound emitting surface of the second speaker 20A are in contact with an internal space of the cabinet 30D.

The processing circuit 82 of the phase control device 80B applied to the speaker apparatus 1D can generate an electric signal S1 and an electric signal S2 in phase with each other. Similarly to the case in the speaker apparatus 1A according to the first embodiment, also in the speaker apparatus 1D according to the fourth embodiment, the condensation and rarefaction of air in the internal space of the cabinet 30D can be suppressed.

Figure 12:
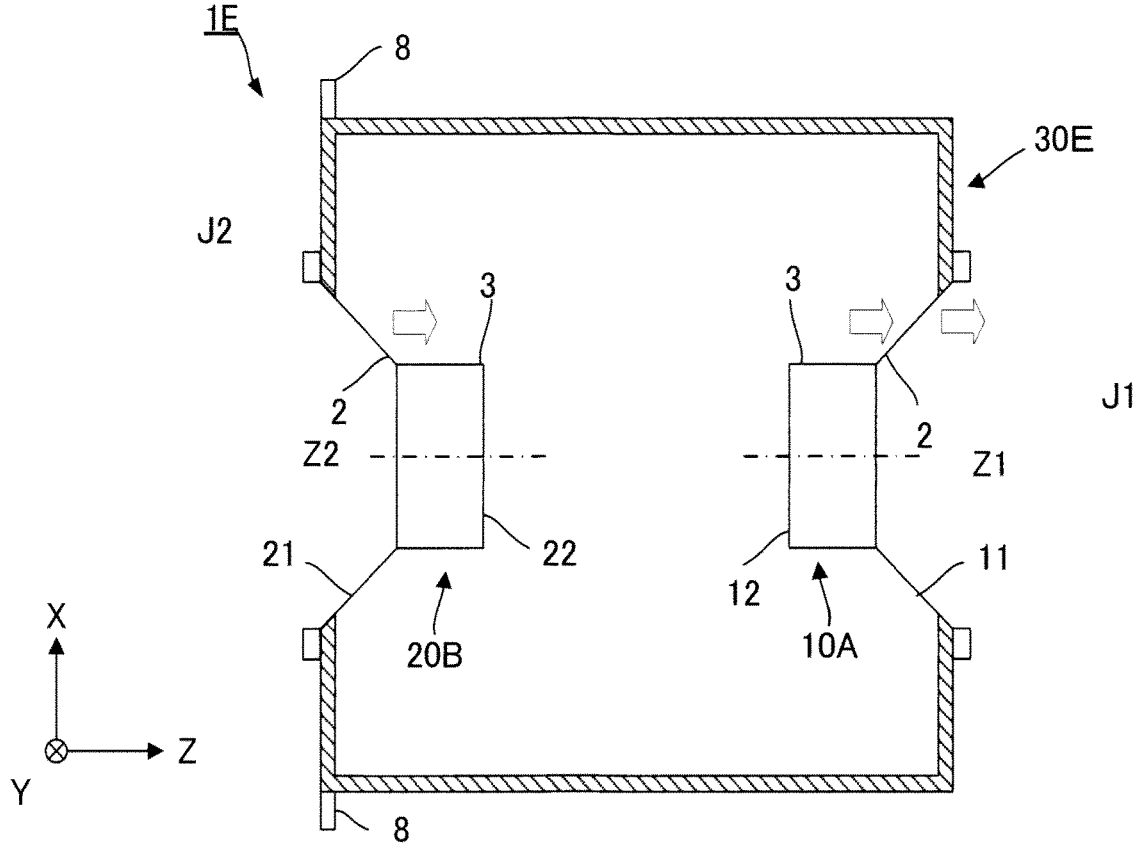
FIG. 12 is a sectional view of a speaker apparatus according to a fifth embodiment.

FIG. 12 is a sectional view of a speaker apparatus 1E according to a fifth embodiment. A cabinet 30E of the speaker apparatus 1E holds a first speaker 10A and a second speaker 20B.

A first surface 11 of the first speaker 10A is a sound emitting surface, and a second surface 12 of the first speaker 10A is a back surface. A first surface 21 of the second speaker 20B is a sound emitting surface, and a second surface 22 of the second speaker 20B is a back surface. The sound emitting surface of the first speaker 10A is in contact with a space communicating with an interior J1. The sound emitting surface of the second speaker 20B is in contact with a space communicating with an exterior J2. The back surface of the first speaker 10A and the back surface of the second speaker 20B are facing each other in the Z-direction. In the speaker apparatus 1E, the back surface of the first speaker 10A and the back surface of the second speaker 20B are in contact with an internal space of the cabinet 30E.

The processing circuit 82 of the phase control device 80A applied to the speaker apparatus 1E generates an electric signal S1 and an electric signal S2 having phases opposite to each other. Similarly to the case in the speaker apparatus 1A according to the first embodiment, also in the speaker apparatus 1E according to the fifth embodiment, the condensation and rarefaction of air in the internal space of the cabinet 30E can be suppressed.

Figure 13:
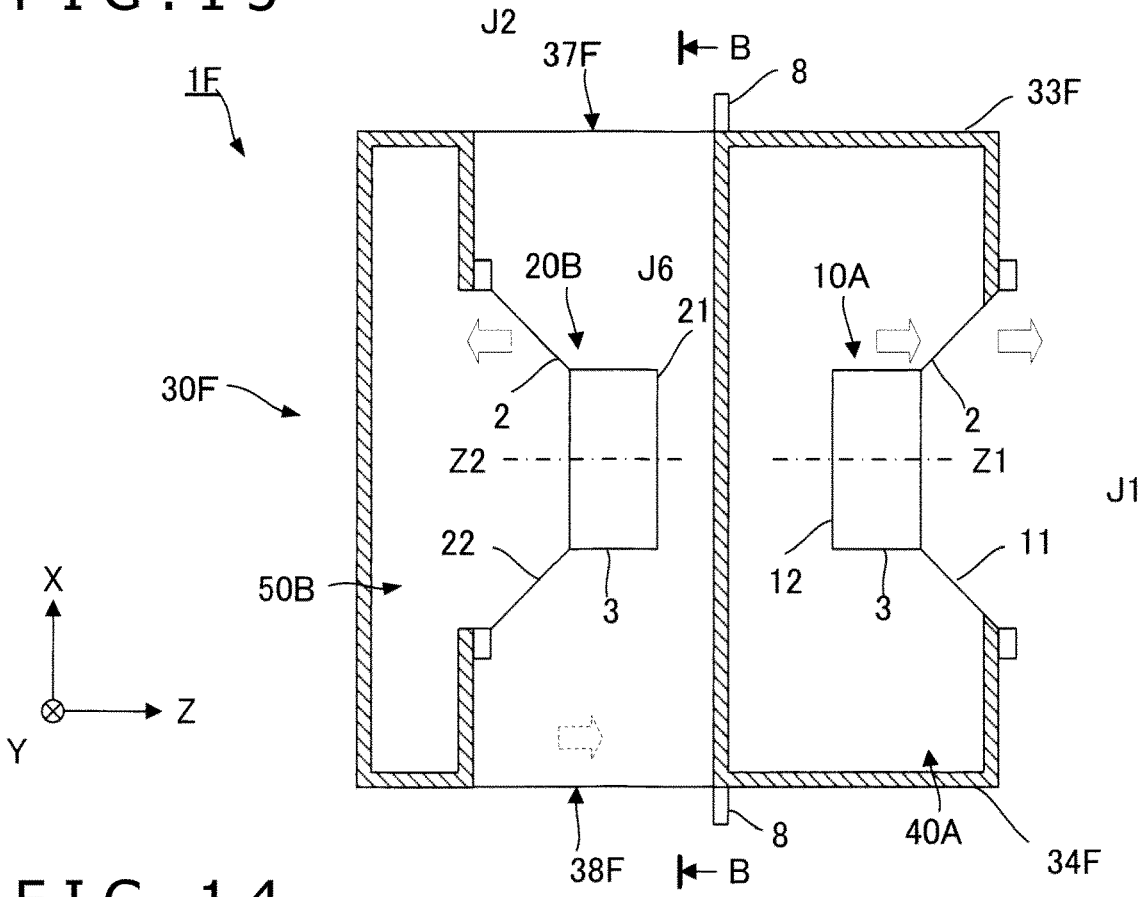
FIG. 13 is a sectional view of a speaker apparatus according to a sixth embodiment.
Figure 14:
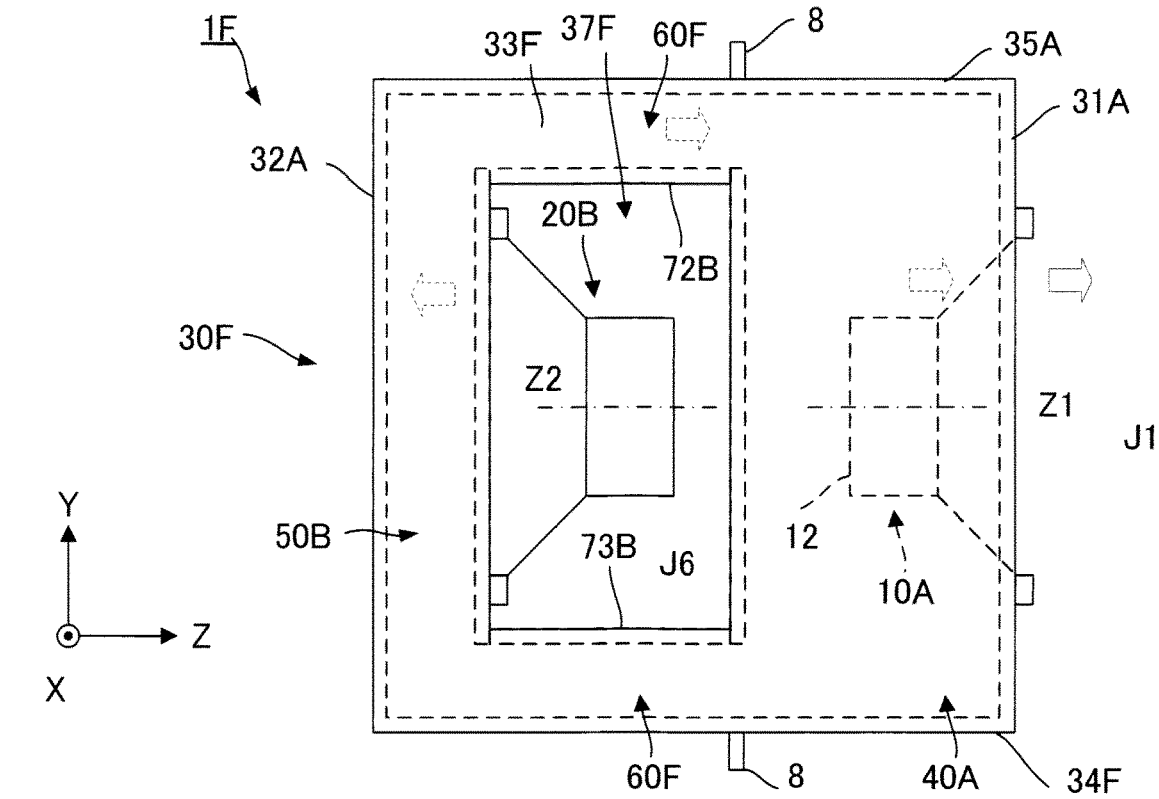
FIG. 14 is a side view of the speaker apparatus according to the sixth embodiment.
Figure 15:
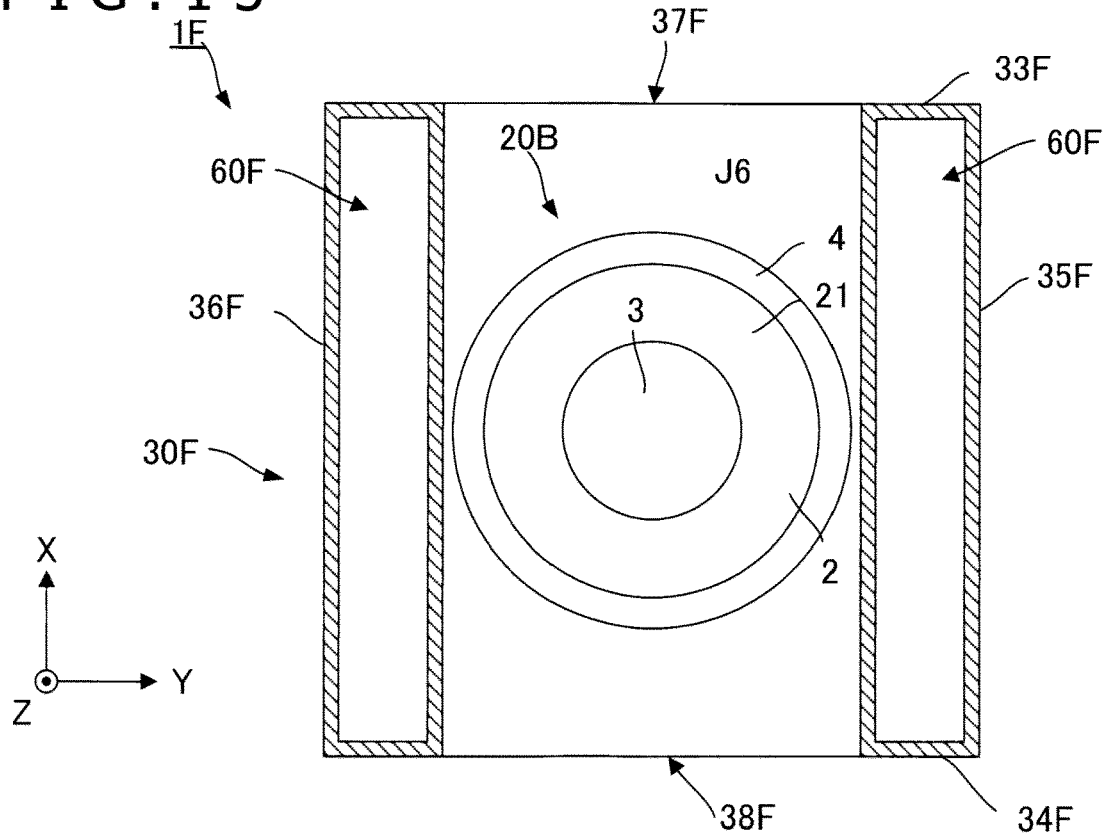
FIG. 15 is a view taken in the direction of arrows along a line B-B in FIG. 13.

FIG. 13 is a sectional view of a speaker apparatus 1F according to a sixth embodiment. FIG. 14 is a side view of the speaker apparatus 1F. FIG. 15 is a view taken in the direction of arrows along a line B-B in FIG. 13. The speaker apparatus 1F according to the sixth embodiment is different from the speaker apparatus 1B according to the second embodiment in that an open space J6 is continuous in the X-direction and in that a coupling portion 60F is disposed on each of both sides of the second speaker 20B in the Y-direction.

The speaker apparatus 1F includes a first speaker 10A, a second speaker 20B, and a cabinet 30F. The cabinet 30F includes a first cabinet 40A holding the first speaker 10A, a second cabinet 50B holding the second speaker 20B, and the coupling portions 60F coupling the first cabinet 40A and the second cabinet 50B to each other.

In the cabinet 30F of the speaker apparatus 1F, a side plate 33F and a side plate 34F facing each other in the X-direction are provided with an opening portion 37F and an opening portion 38F. The opening portion 37F is provided in the side plate 33F. The opening portion 38F is provided in the side plate 34F. The open space J6 is formed in a region ranging from the opening portion 37F to the opening portion 38F in the X-direction. The coupling portions 60F are formed between a side plate 35F and a side plate 36F in the Y-direction.

Similarly to the case in the speaker apparatus 1B according to the second embodiment, also in the speaker apparatus 1F according to the sixth embodiment, the condensation and rarefaction of air in an internal space of the cabinet 30F can be suppressed, and a shift in the center of gravity of the cabinet 30F can be suppressed.

Figure 16:
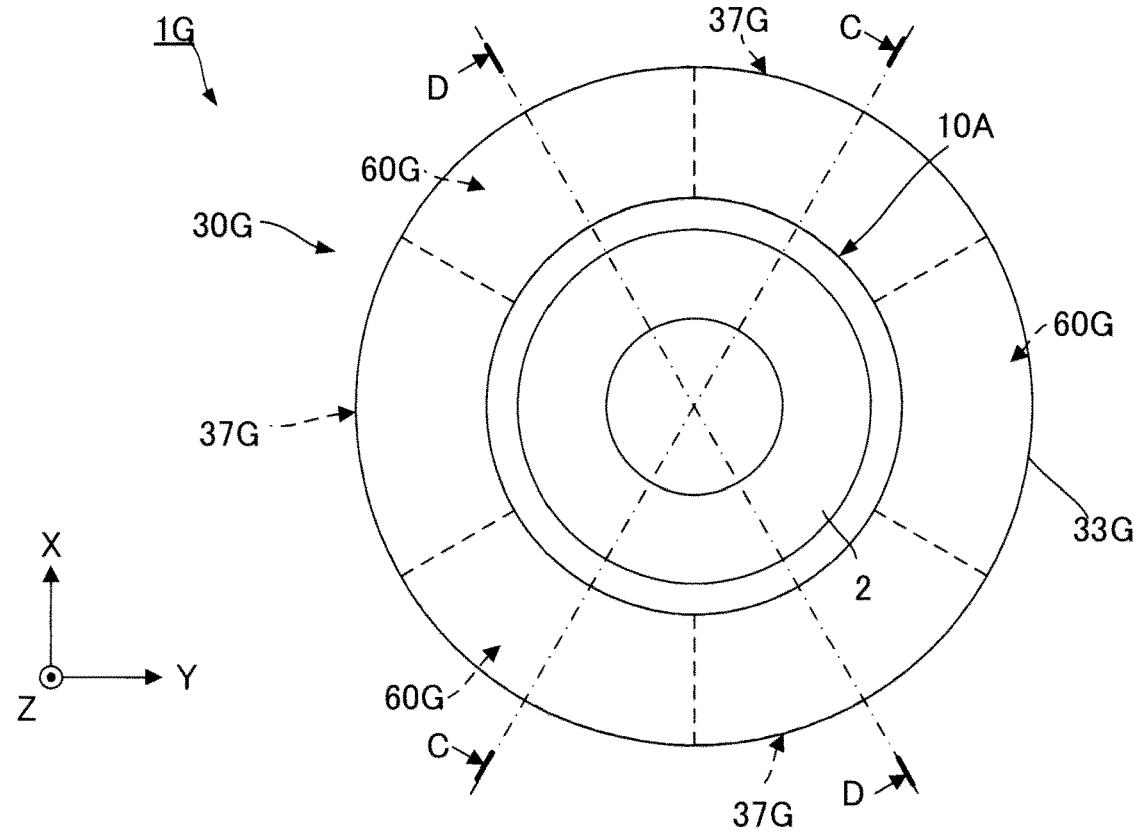
FIG. 16 is a front view of a speaker apparatus according to a seventh embodiment.
Figure 17:
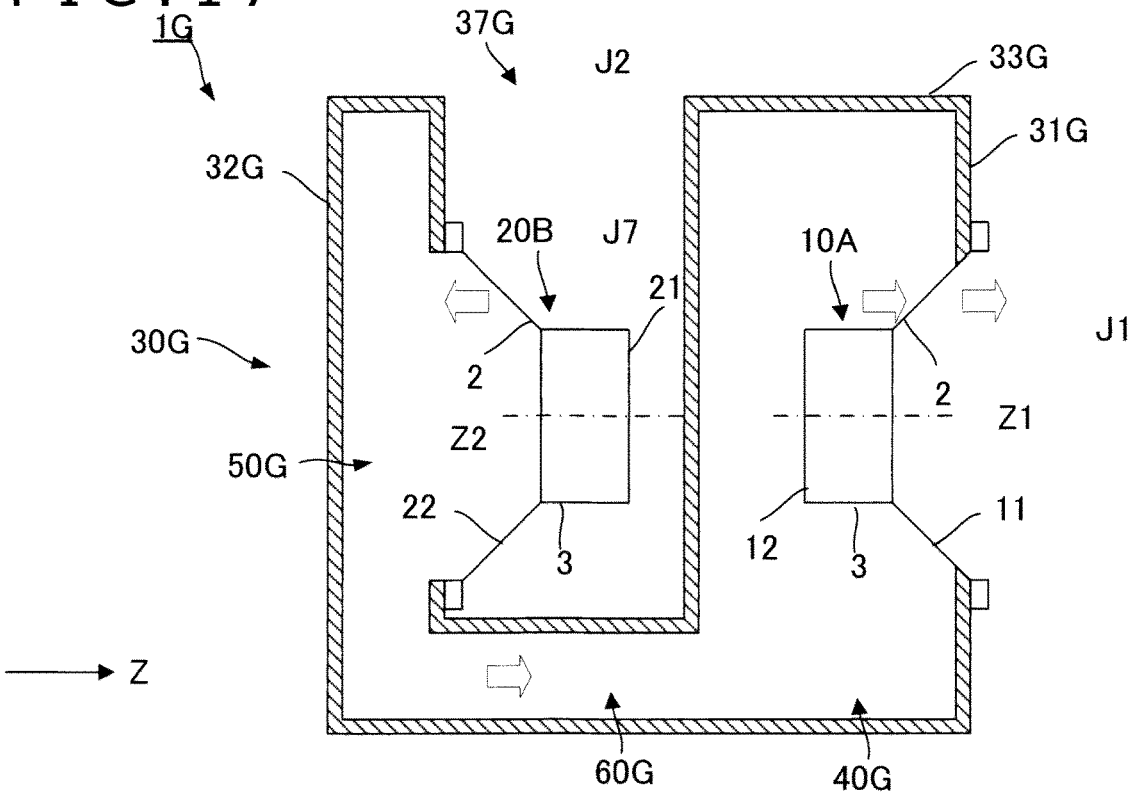
FIG. 17 is a view taken in the direction of arrows along a line C-C in FIG. 16.
Figure 18:
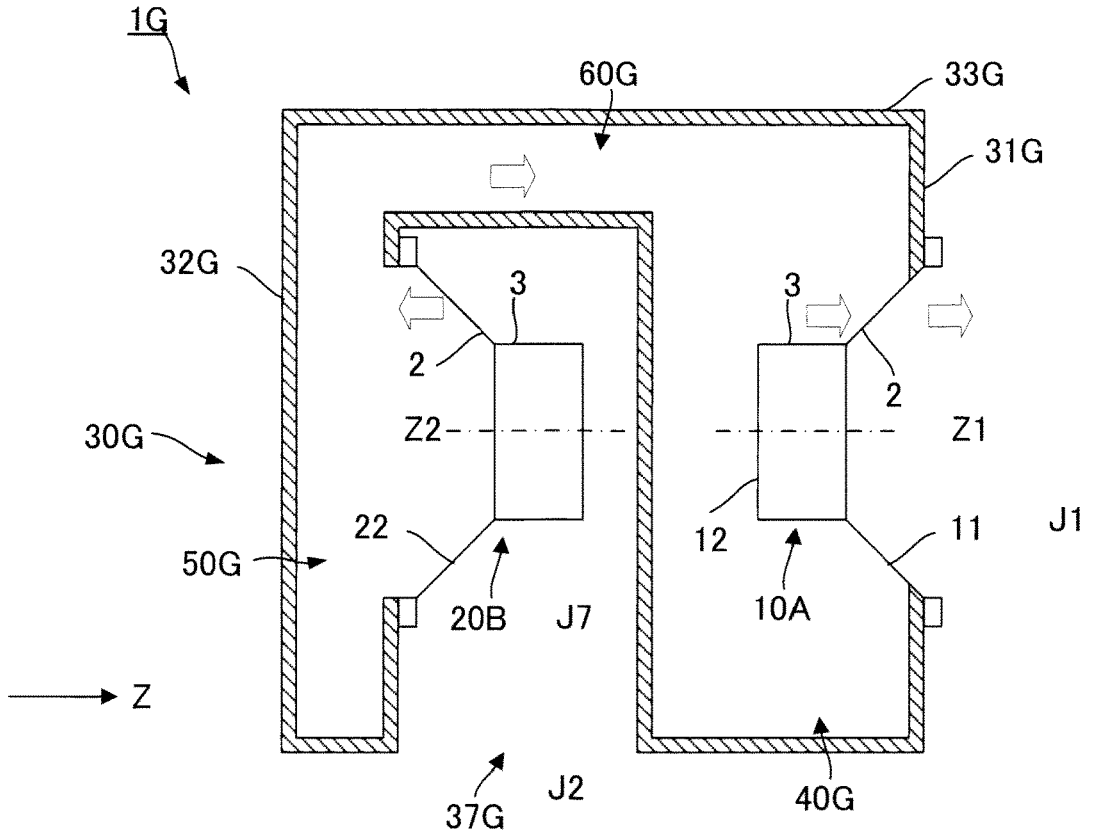
FIG. 18 is a view taken in the direction of arrows along a line D-D in FIG. 16.

A speaker apparatus 1G according to a seventh embodiment will next be described. FIG. 16 is a front view of the speaker apparatus 1G. FIG. 17 is a view taken in the direction of arrows along a line C-C in FIG. 16. FIG. 18 is a view taken in the direction of arrows along a line D-D in FIG. 16. The sectional shape of the speaker apparatus 1G illustrated in FIG. 17 is the same as the sectional shape of the speaker apparatus 1B according to the second embodiment illustrated in FIG. 2. The sectional shape of the speaker apparatus 1G illustrated in FIG. 18 is obtained by vertically inverting the sectional shape illustrated in FIG. 17.

The speaker apparatus 1G includes a first speaker 10A, a second speaker 20B, and a cabinet 30G. The cabinet 30G includes a first cabinet 40G holding the first speaker 10A, a second cabinet 50G holding the second speaker 20B, and coupling portions 60G coupling the first cabinet 40G and the second cabinet 50G to each other.

The cabinet 30G includes a front plate 31G, a back plate 32G, and a side plate 33G. The side plate 33G is formed into a tubular shape. The side plate 33G is formed so as to surround an axis Z1 and an axis Z2.

The coupling portions 60G are formed between the first cabinet 40G and the second cabinet 50G in the Z-direction. Internal spaces of the coupling portions 60G are made to communicate with an internal space of the first cabinet 40G and an internal space of the second cabinet 50G. The sectional shape of the coupling portions 60G has a sectorial shape.

Opening portions 37G are formed in the side plate 33G. An open space J7 communicating with an exterior J2 is formed on the back side of the second speaker 20B. The open space J7 communicates with the exterior J2 through the opening portions 37G. The opening portions 37G and the coupling portions 60G are arranged alternately in the circumferential direction of the side plate 33G. The first cabinet 40G and the second cabinet 50G are coupled to each other by three coupling portions 60G, for example.

Similarly to the case in the speaker apparatus 1B according to the second embodiment, also in the speaker apparatus 1G according to the seventh embodiment, the condensation and rarefaction of air in an internal space of the cabinet 30G can be suppressed, and a shift in the center of gravity of the cabinet 30G can be suppressed.

The cabinet 30G of the speaker apparatus 1G has a circular external shape. The speaker apparatus 1G may be mounted in a central opening portion of a spare tire. For example, in a trunk of a vehicle, the speaker apparatus 1G is retained by the spare tire, a first surface 11 of the first speaker 10A may communicate with the interior of the vehicle, and a first surface 21 of the second speaker 20B may communicate with the outside of the interior of the vehicle.

Figure 19:
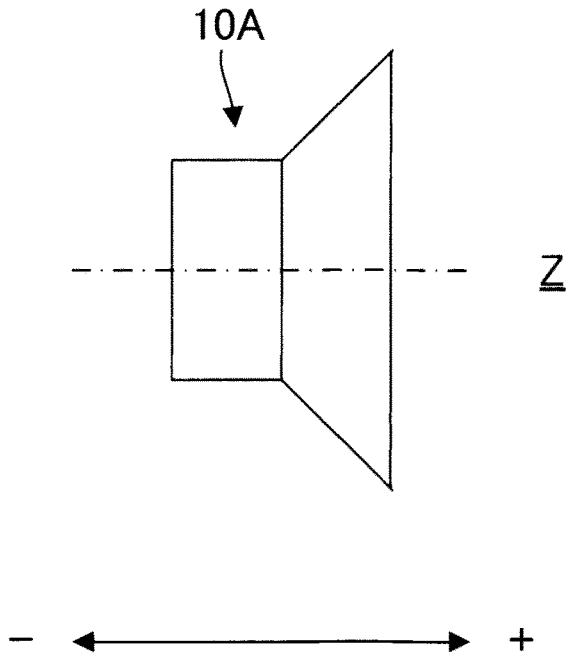
FIG. 19 is a schematic diagram illustrating a model of a first speaker.

Distortion of sound in a model of the first speaker 10A will next be described with reference to FIG. 19 and FIG. 20. FIG. 19 is a schematic diagram illustrating the model of the first speaker 10A. A right side illustrated in the figure is a positive direction, and a left side illustrated in the figure is a negative direction. The sound emitting surface of the first speaker 10A is disposed in the positive direction, and the back surface of the first speaker 10A is disposed in the negative direction.

Figure 20:
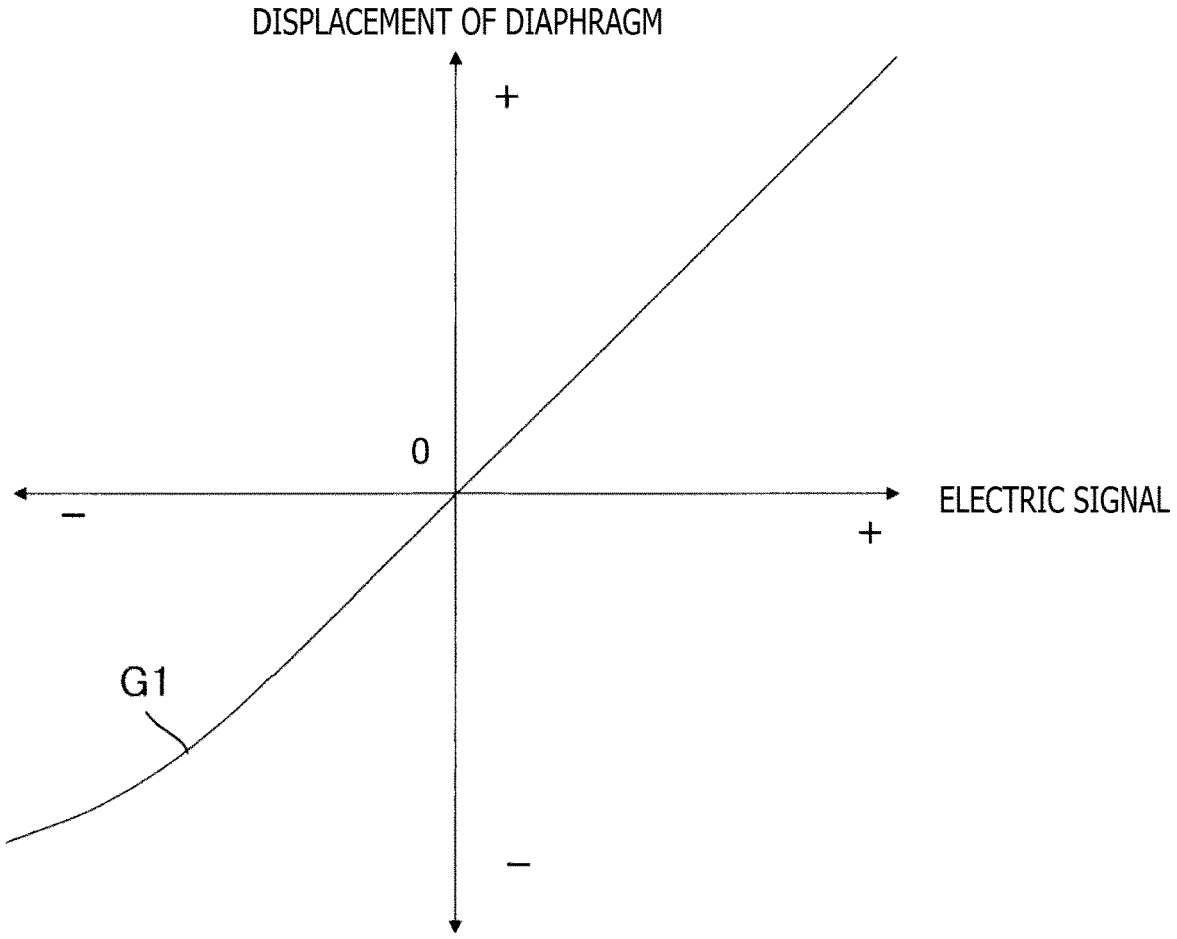
FIG. 20 is a graph illustrating distortion of sound in the model of the first speaker illustrated in FIG. 19.

FIG. 20 is a graph illustrating distortion of sound in the model of the first speaker 10A illustrated in FIG. 19. An axis of abscissas indicates an electric signal. An axis of ordinates indicates displacement of the diaphragm 2. A graph G1 illustrated in FIG. 20 represents a relation between the electric signal and the displacement of the diaphragm 2 in the model of the first speaker 10A. In the speaker, there is no symmetry of displacement of the diaphragm 2 between the positive direction and the negative direction with respect to the electric signal due to the structure of the speaker. This is the distortion of sound and is a second-order distortion.

Figure 21:
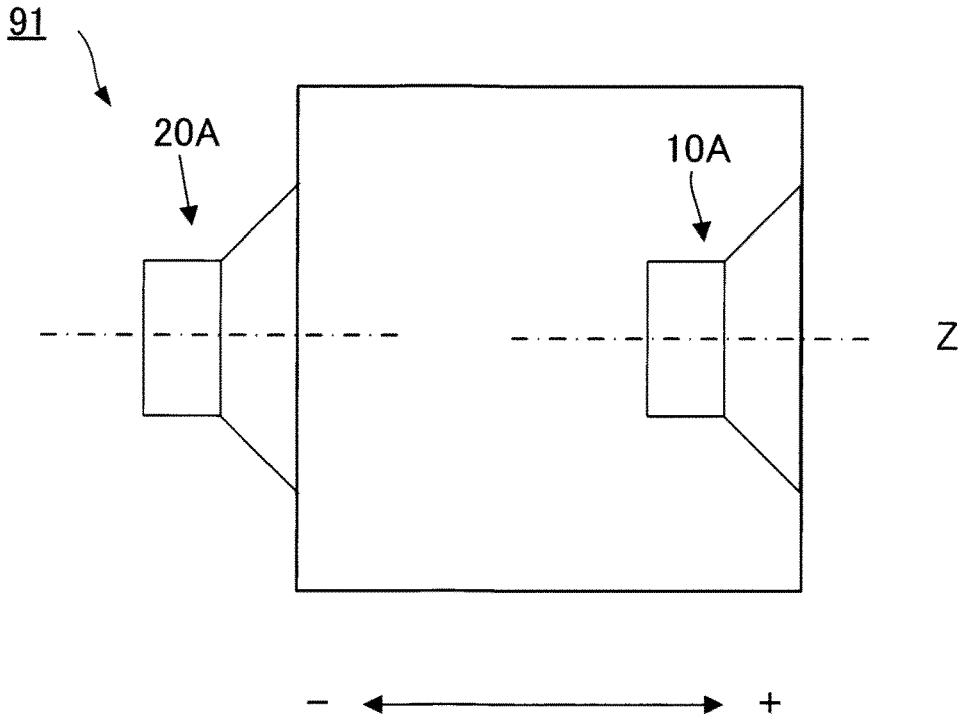
FIG. 21 is a schematic diagram illustrating a model of a speaker apparatus including the first speaker and a second speaker arranged in the same orientation.

Next, referring to FIG. 21 and FIG. 22, description will be made of distortion of sound in a model of a speaker apparatus 91 including the first speaker 10A and the second speaker 20A arranged in the same orientation. FIG. 21 is a schematic diagram illustrating the model of the speaker apparatus 91. In the speaker apparatus 91, the sound emitting surface of the first speaker 10A is disposed in the positive direction, and the back surface of the first speaker 10A is disposed in the negative direction. The sound emitting surface of the second speaker 20A is disposed in the positive direction, and the back surface of the second speaker 20A is disposed in the negative direction.

Figure 22:
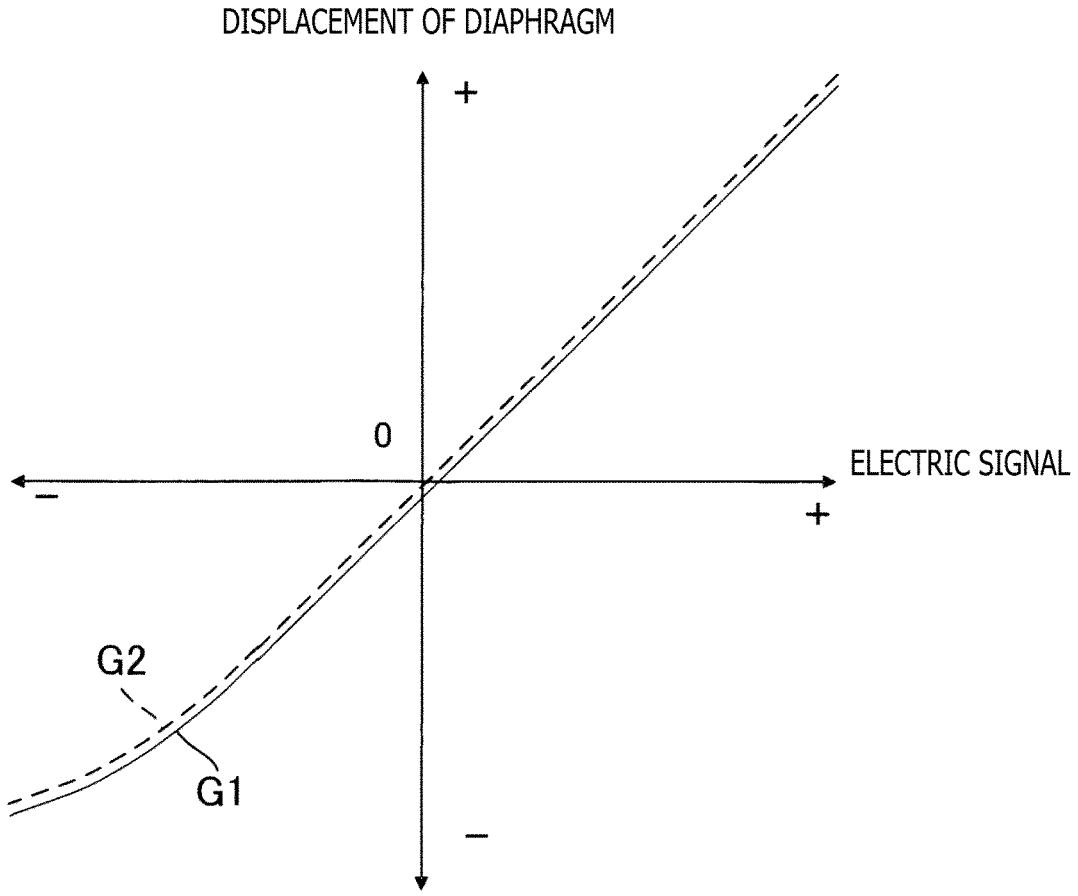
FIG. 22 is a graph illustrating distortion of sound in the model of the speaker apparatus illustrated in FIG. 21.

FIG. 22 is a graph illustrating distortion of sound in the model of the speaker apparatus 91 illustrated in FIG. 21. A graph G2 illustrated in FIG. 22 is a graph representing a relation between the electric signal and the displacement of the diaphragm 2 in the model of the second speaker 20A. When sound is output with the first speaker 10A and the second speaker 20A arranged in the same orientation, similar distortion appears in the displacement of the diaphragm 2 of the first speaker 10A and the displacement of the diaphragm 2 of the second speaker 20A.

Figure 23:
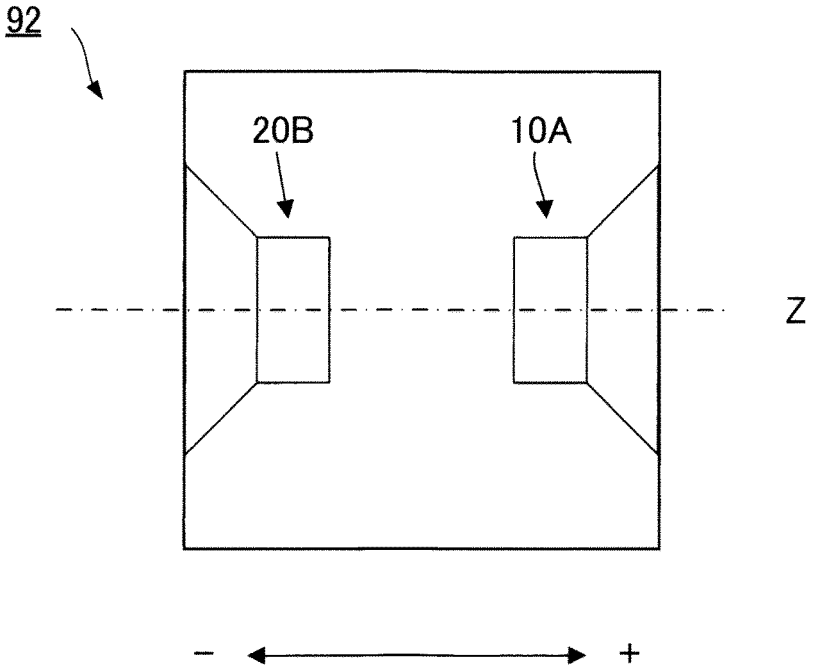
FIG. 23 is a schematic diagram illustrating a model of a speaker apparatus including the first speaker and a second speaker arranged in opposite orientations.

Next, referring to FIG. 23 and FIG. 24, description will be made of distortion of sound in a model of a speaker apparatus 92 including the first speaker 10A and the second speaker 20B arranged in opposite orientations. FIG. 23 is a schematic diagram illustrating the model of the speaker apparatus 92. In the speaker apparatus 92, the sound emitting surface of the first speaker 10A is disposed in the positive direction, and the back surface of the first speaker 10A is disposed in the negative direction. The sound emitting surface of the second speaker 20B is disposed in the negative direction, and the back surface of the second speaker 20B is disposed in the positive direction.

Figure 24:
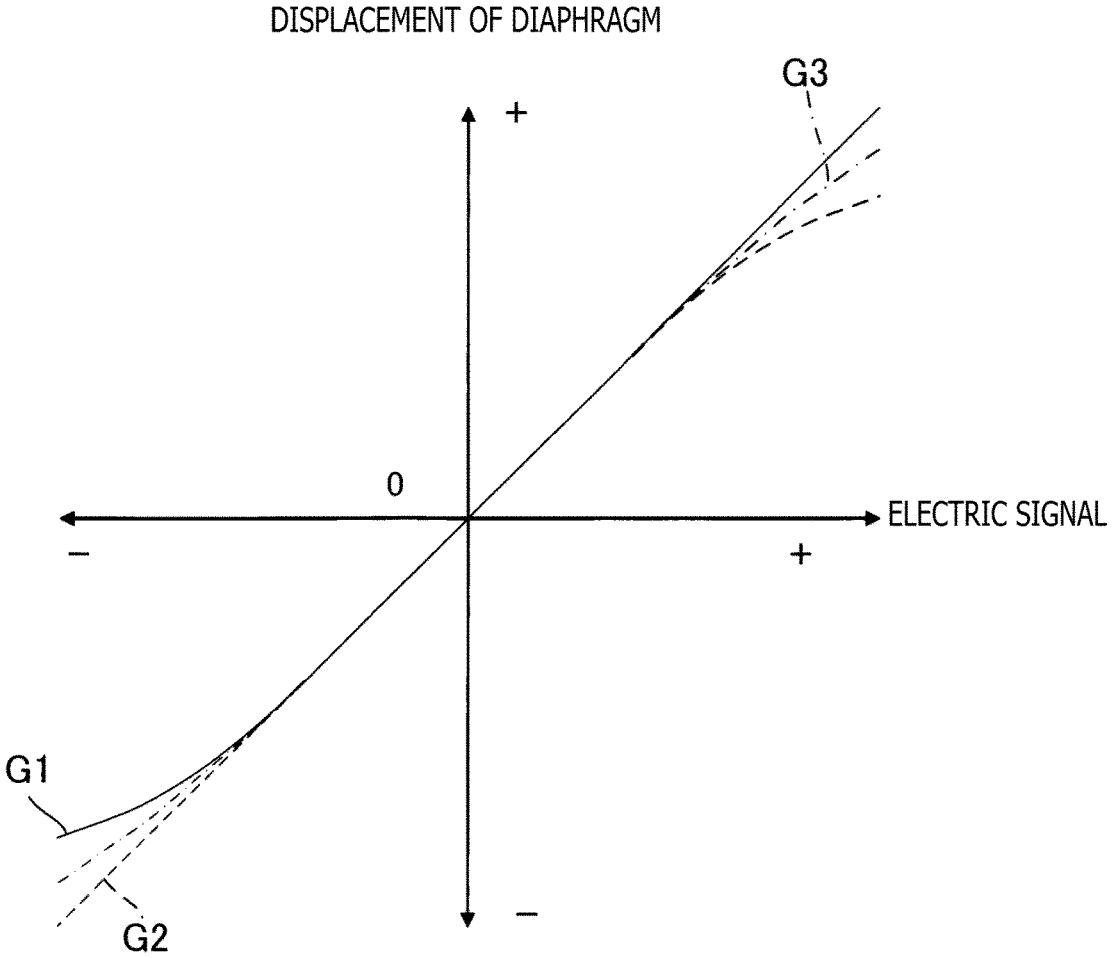
FIG. 24 is a graph illustrating distortion of sound in the model of the speaker apparatus illustrated in FIG. 23.

FIG. 24 is a graph illustrating distortion of sound in the model of the speaker apparatus 92 illustrated in FIG. 23. A graph G3 illustrated in FIG. 24 is a graph representing a relation between the electric signal and the displacement of the diaphragm 2 in the model of the second speaker 20B. The speaker apparatus 92 outputs the electric signal S1 and the electric signal S2 having phases opposite to each other, to the first speaker 10A and the second speaker 20B. Distortion in the displacement of the diaphragm 2 by the speaker apparatus 92 in this case is reduced as in the graph G3. The graph G3 is symmetric with respect to a zero point in the positive direction and the negative direction. Thus, a third-order distortion having a small effect on sound quality occurs.

It is to be noted that the foregoing embodiments merely represent typical examples of the present disclosure and that the present disclosure is not limited to the foregoing embodiments and is susceptible of various changes and additions without departing from the spirit of the present disclosure.

While the interior J1 and the exterior J2 have been illustrated in the foregoing embodiments, the interior J1 and the exterior J2 may be opposite. For example, in the first embodiment illustrated in FIG. 1, the reference sign J1 may denote the exterior, and the reference sign J2 may denote the interior. In this case, the speaker indicated by the reference sign 10A is the second speaker, and the speaker indicated by the reference sign 20A is the first speaker. The interior J1 and the exterior J2 may also be opposite in the second to seventh embodiments.

In the speaker apparatus 1A, the second surface 12 of the first speaker 10A may be a sound emitting surface. In this case, the back surface of the first speaker 10A communicates with the interior J1, and the sound emitting surface of the first speaker 10A does not communicate with the interior J1. In the speaker apparatus 1A, a configuration in which the second surface 12 of the first speaker 10A is a sound emitting surface and in which the second surface 22 of the second speaker 20A is a sound emitting surface may be adopted. In the speaker apparatus 1A, a configuration in which the second surface 12 of the first speaker 10A is a sound emitting surface and in which the second surface 22 of the second speaker 20A is a back surface may be adopted. In the speaker apparatus 1A, a configuration in which the sound emitting surfaces of the first speaker 10A and the second speaker 20A are arranged so as to be facing each other may be adopted.

In foregoing embodiments, sound signals supplied to the first speaker 10A have opposite phases to sound signals supplied to the second speaker 20A, but the sound signals supplied to the first speaker 10A and the sound signals supplied to the second speaker 20A may have phases other than the opposite phases. In foregoing embodiments, sound signals supplied to the first speaker 10A have the same phase as sound signals supplied to the second speaker 20B, but the sound signals supplied to the first speaker 10A and the sound signals supplied to the second speaker 20B may have phases other than the same phase.

While the first speaker 10A and the second speaker 20A are arranged coaxially in foregoing embodiments, the first speaker 10A and the second speaker 20A are not limited to being arranged coaxially. The axis Z1 of the first speaker 10A and the axis Z2 of the second speaker 20A may be parallel with each other, and the first speaker 10A and the second speaker 20A may overlap as viewed from a direction along the axis Z1 of the first speaker 10A.

The axis Z1 of the first speaker 10A and the axis Z2 of the second speaker 20A may not be parallel with each other. The axis Z1 may be inclined with respect to the axis Z2.

In foregoing embodiments, the phase control unit 85A may change the phase control according to frequency. It is possible for the phase control unit 85A, for example, not to change the phases when the frequency is 100 Hz or lower and to make the phases opposite phases when the frequency exceeds 100 Hz.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2020-162631 filed in the Japan Patent Office on Sep. 28, 2020, the entire content of which is hereby incorporated by reference.

What is claimed is:

1. A speaker apparatus comprising:

a first speaker having a first surface communicating with an interior and a second surface not communicating with the interior;

a second speaker having a first surface communicating with an exterior and a second surface not communicating with the exterior; and a cabinet having boundary surfaces that form an enclosed space, wherein the second surface of the first speaker and the second surface of the second speaker are arranged on the boundary surfaces and are facing the enclosed space.

2. The speaker apparatus according to claim 1, wherein the second surface of the first speaker is a back surface of the first speaker, and the second surface of the second speaker is a back surface of the second speaker.

3. The speaker apparatus according to claim 1, wherein the second surface of the first speaker is a sound emitting surface of the first speaker, and the second surface of the second speaker is a sound emitting surface of the second speaker.

4. The speaker apparatus according to claim 2, wherein sound signals supplied to the first speaker have opposite phases to sound signals supplied to the second speaker.

5. The speaker apparatus according to claim 4, wherein the first speaker and the second speaker are arranged coaxially and in a same orientation.

6. The speaker apparatus according to claim 1, wherein the second surface of the first speaker is a back surface of the first speaker, and the second surface of the second speaker is a sound emitting surface of the second speaker.

7. The speaker apparatus according to claim 1, wherein the second surface of the first speaker is a sound emitting surface of the first speaker, and the second surface of the second speaker is a back surface of the second speaker.

8. The speaker apparatus according to claim 6, wherein sound signals supplied to the first speaker have the same phase as sound signals supplied to the second speaker.

9. The speaker apparatus according to claim 8, wherein the first speaker and the second speaker are arranged coaxially such that the back surface of the first speaker and a back surface of the second speaker are facing each other.

10. The speaker apparatus according to claim 8, wherein a sound emitting surface of the first speaker and the sound emitting surface of the second speaker are arranged so as to face each other.

11. The speaker apparatus according to claim 1, wherein an axis of the first speaker and an axis of the second speaker are parallel with each other, and the first speaker and the second speaker overlap as viewed from a direction along the axis of the first speaker.

12. An acoustic system comprising:

the speaker apparatus according to claim 1; and a phase control unit that generates a first sound signal and a second sound signal having different phases and supplies the first sound signal and the second sound signal to the first speaker and the second speaker, respectively.

* * * * *